US008226493B2

(12) United States Patent
Briggs et al.

(10) Patent No.: US 8,226,493 B2
(45) **Date of Patent: *Jul. 24, 2012**

(54) INTERACTIVE PLAY DEVICES FOR WATER PLAY ATTRACTIONS

(75) Inventors: Rick A. Briggs, Springfield, IL (US); Denise Chapman Weston, Wakefield, RI (US)

(73) Assignee: Creative Kingdoms, LLC, Wakefield, RI (US)

( * ) Notice: Subject to any disclaimer, the term of this patent is extended or adjusted under 35 U.S.C. 154(b) by 142 days.

This patent is subject to a terminal disclaimer.

(21) Appl. No.: 12/717,809

(22) Filed: Mar. 4, 2010

(65) Prior Publication Data

US 2010/0203932 A1 Aug. 12, 2010

Related U.S. Application Data

(63) Continuation of application No. 11/406,521, filed on Apr. 18, 2006, now Pat. No. 7,674,184, which is a continuation-in-part of application No. 10/632,556, filed on Aug. 1, 2003, now Pat. No. 7,029,400.

(60) Provisional application No. 60/400,430, filed on Aug. 1, 2002.

(51) Int. Cl.
*A63H 23/10* (2006.01)
*A63H 23/00* (2006.01)

(52) U.S. Cl. ..... 472/128; 273/440; 472/133

(58) Field of Classification Search ..... 472/117, 472/128, 133, 136; 273/440; 482/35, 36
See application file for complete search history.

(56) References Cited

U.S. PATENT DOCUMENTS

| | | | |
|---|---|---|---|
| 1,661,058 | A | 2/1928 | Theremin |
| 1,789,680 | A | 1/1931 | Gwinnett |
| 2,752,725 | A | 7/1956 | Unsworth |
| 2,902,023 | A | 9/1959 | Waller |
| 3,135,512 | A | 6/1964 | Taylor |
| 3,454,920 | A | 7/1969 | Mehr |
| 3,456,134 | A | 7/1969 | Ko |
| 3,474,241 | A | 10/1969 | Kuipers |
| D220,268 | S | 3/1971 | Kliewer |
| 3,572,712 | A | 3/1971 | Vick |
| 3,660,648 | A | 5/1972 | Kuipers |
| 3,707,055 | A | 12/1972 | Pearce |

(Continued)

FOREIGN PATENT DOCUMENTS

| | | |
|---|---|---|
| CN | 1032246 | 4/1989 |

(Continued)

OTHER PUBLICATIONS

"Owl Magic Wand and Owl Magic Orb" Press Release by Emerald Forest Toys (Nov. 2001).

(Continued)

*Primary Examiner* — Kien Nguyen
(74) *Attorney, Agent, or Firm* — Knobbe, Martens, Olson & Bear LLP

(57) ABSTRACT

A system of interactive game play is provided wherein the gaming is carried out within a pool, water park or water attraction. The game utilizes electronically identifiable objects, such as waterproof wands, cards, bands, tags and/or the like, to provide an interactive game play experience generally simulative of a computer adventure game. Play participants are challenged to work and cooperate with other play participants to find and use identified objects, clues or other information to solve various puzzles or problems that present encumbrances inhibiting participants' advancement in the game. Each play participant may possess a unique RFID wand, band, card or the like, that electronically identifies the play participant and enables the play system to award and track points or other rewards to successful play participants individually or working with other play participants as a team.

20 Claims, 6 Drawing Sheets

U.S. PATENT DOCUMENTS

| | | | |
|---|---|---|---|
| 3,795,805 | A | 3/1974 | Swanberg et al. |
| 3,843,127 | A | 10/1974 | Lack |
| 3,949,364 | A | 4/1976 | Clark et al. |
| 3,973,257 | A | 8/1976 | Rowe |
| 3,978,481 | A | 8/1976 | Angwin et al. |
| 3,997,156 | A | 12/1976 | Barlow et al. |
| 4,009,619 | A | 3/1977 | Snyman |
| 4,038,876 | A | 8/1977 | Morris |
| 4,055,341 | A | 10/1977 | Martinez |
| 4,166,406 | A | 9/1979 | Maughmer |
| 4,171,737 | A | 10/1979 | McLaughlin |
| 4,205,785 | A | 6/1980 | Stanley |
| 4,231,077 | A | 10/1980 | Joyce et al. |
| 4,240,638 | A | 12/1980 | Morrison et al. |
| 4,282,681 | A | 8/1981 | McCaslin |
| 4,287,765 | A | 9/1981 | Kreft |
| 4,296,929 | A | 10/1981 | Meyer et al. |
| 4,303,978 | A | 12/1981 | Shaw |
| 4,318,245 | A | 3/1982 | Stowell et al. |
| 4,321,678 | A | 3/1982 | Krogmann |
| 4,325,199 | A | 4/1982 | McEdwards |
| 4,337,948 | A | 7/1982 | Breslow |
| 4,342,985 | A | 8/1982 | Desjardins |
| 4,402,250 | A | 9/1983 | Baasch |
| 4,412,205 | A | 10/1983 | Von Kemenczky |
| 4,425,488 | A | 1/1984 | Moskin |
| 4,443,866 | A | 4/1984 | Burgiss |
| 4,450,325 | A | 5/1984 | Luque |
| 4,503,299 | A | 3/1985 | Henrard |
| 4,514,600 | A | 4/1985 | Lentz |
| 4,514,798 | A | 4/1985 | Lesche |
| 4,540,176 | A | 9/1985 | Baer |
| 4,546,551 | A | 10/1985 | Franks |
| 4,558,604 | A | 12/1985 | Auer |
| 4,561,299 | A | 12/1985 | Orlando |
| 4,575,621 | A | 3/1986 | Dreifus |
| 4,578,674 | A | 3/1986 | Baker et al. |
| 4,595,369 | A | 6/1986 | Downs |
| 4,623,887 | A | 11/1986 | Welles |
| 4,623,930 | A | 11/1986 | Oshima |
| 4,627,620 | A | 12/1986 | Yang |
| 4,672,374 | A | 6/1987 | Desjardins |
| 4,678,450 | A | 7/1987 | Scolari et al. |
| 4,695,058 | A | 9/1987 | Carter, III et al. |
| 4,695,953 | A | 9/1987 | Blair et al. |
| 4,739,128 | A | 4/1988 | Grisham |
| 4,750,733 | A | 6/1988 | Foth |
| 4,761,540 | A | 8/1988 | McGeorge |
| 4,787,051 | A | 11/1988 | Olson |
| 4,816,810 | A | 3/1989 | Moore |
| 4,817,950 | A | 4/1989 | Goo |
| 4,839,838 | A | 6/1989 | LaBiche et al. |
| 4,846,568 | A | 7/1989 | Krueger |
| 4,849,655 | A | 7/1989 | Bennett |
| 4,851,685 | A | 7/1989 | Dubgen |
| 4,858,390 | A | 8/1989 | Kenig |
| 4,858,930 | A | 8/1989 | Sato |
| 4,862,165 | A | 8/1989 | Gart |
| 4,891,032 | A | 1/1990 | Davis |
| 4,904,222 | A | 2/1990 | Gastgeb et al. |
| 4,910,677 | A | 3/1990 | Remedio et al. |
| 4,914,598 | A | 4/1990 | Krogmann |
| 4,918,293 | A | 4/1990 | McGeorge |
| 4,924,358 | A | 5/1990 | Von Heck |
| 4,957,291 | A | 9/1990 | Miffitt |
| 4,960,275 | A | 10/1990 | Magon |
| 4,961,369 | A | 10/1990 | McGill |
| 4,964,837 | A | 10/1990 | Collier |
| 4,967,321 | A | 10/1990 | Cimock |
| 4,969,647 | A | 11/1990 | Mical et al. |
| 4,980,519 | A | 12/1990 | Mathews |
| 4,994,795 | A | 2/1991 | MacKenzie |
| 5,011,161 | A | 4/1991 | Galphin |
| 5,036,442 | A | 7/1991 | Brown |
| 5,045,843 | A | 9/1991 | Hansen |
| 5,048,831 | A | 9/1991 | Sides |
| D320,624 | S | 10/1991 | Taylor |
| 5,058,480 | A | 10/1991 | Suzuki et al. |
| 5,059,958 | A | 10/1991 | Jacobs et al. |
| 5,062,696 | A | 11/1991 | Oshima |
| 5,068,645 | A | 11/1991 | Drumm |
| D322,242 | S | 12/1991 | Cordell |
| 5,076,584 | A | 12/1991 | Openiano |
| D325,225 | S | 4/1992 | Adhida |
| 5,114,155 | A | 5/1992 | Tillery et al. |
| 5,114,344 | A | 5/1992 | Fumagalli et al. |
| 5,124,938 | A | 6/1992 | Algrain |
| 5,127,657 | A | 7/1992 | Ikezawa et al. |
| 5,128,671 | A | 7/1992 | Thomas, Jr. |
| D328,463 | S | 8/1992 | King et al. |
| 5,136,222 | A | 8/1992 | Yamamoto |
| 5,138,154 | A | 8/1992 | Hotelling |
| 5,145,446 | A | 9/1992 | Kuo |
| D331,058 | S | 11/1992 | Morales |
| 5,166,502 | A | 11/1992 | Rendleman |
| 5,175,481 | A | 12/1992 | Kanno |
| 5,177,311 | A | 1/1993 | Suzuki et al. |
| 5,178,477 | A | 1/1993 | Gambaro |
| 5,181,181 | A | 1/1993 | Glynn |
| 5,184,830 | A | 2/1993 | Okada et al. |
| 5,192,823 | A | 3/1993 | Suzuki et al. |
| 5,194,006 | A | 3/1993 | Zaenglein, Jr. |
| 5,194,048 | A | 3/1993 | Briggs |
| 5,202,844 | A | 4/1993 | Kamio |
| 5,207,426 | A | 5/1993 | Inoue et al. |
| 5,212,368 | A | 5/1993 | Hara |
| 5,213,327 | A | 5/1993 | Kitaue |
| 5,223,698 | A | 6/1993 | Kapur |
| 5,231,568 | A | 7/1993 | Cohen et al. |
| D338,242 | S | 8/1993 | Cordell |
| 5,232,223 | A | 8/1993 | Dornbusch |
| 5,247,651 | A | 9/1993 | Clarisse |
| D340,042 | S | 10/1993 | Copper et al. |
| 5,259,626 | A | 11/1993 | Ho |
| 5,262,777 | A | 11/1993 | Low et al. |
| D342,256 | S | 12/1993 | Payne et al. |
| 5,277,645 | A | 1/1994 | Kelley et al. |
| 5,279,513 | A | 1/1994 | Connelly |
| 5,280,744 | A | 1/1994 | DeCarlo |
| D345,164 | S | 3/1994 | Grae |
| 5,292,124 | A | 3/1994 | Carpenter |
| 5,292,254 | A | 3/1994 | Miller et al. |
| 5,296,871 | A | 3/1994 | Paley |
| 5,299,967 | A | 4/1994 | Gilbert |
| 5,307,325 | A | 4/1994 | Scheiber |
| 5,317,394 | A | 5/1994 | Hale |
| 5,319,548 | A | 6/1994 | Germain |
| 5,320,358 | A | 6/1994 | Jones |
| 5,320,362 | A | 6/1994 | Bear et al. |
| 5,329,276 | A | 7/1994 | Hirabayashi |
| 5,332,322 | A | 7/1994 | Gambaro |
| 5,339,095 | A | 8/1994 | Redford |
| D350,736 | S | 9/1994 | Takahashi et al. |
| D350,782 | S | 9/1994 | Barr |
| D351,430 | S | 10/1994 | Barr |
| 5,354,057 | A | 10/1994 | Pruitt et al. |
| 5,356,343 | A | 10/1994 | Lovetere |
| 5,357,267 | A | 10/1994 | Inoue |
| 5,359,321 | A | 10/1994 | Ribic |
| 5,359,348 | A | 10/1994 | Pilcher et al. |
| 5,363,120 | A | 11/1994 | Drumm |
| 5,365,214 | A | 11/1994 | Angott et al. |
| 5,366,229 | A | 11/1994 | Suzuki |
| 5,369,580 | A | 11/1994 | Monji |
| 5,369,889 | A | 12/1994 | Callaghan |
| 5,373,857 | A | 12/1994 | Travers et al. |
| 5,378,197 | A | 1/1995 | Briggs |
| 5,382,026 | A | 1/1995 | Harvard et al. |
| 5,393,074 | A | 2/1995 | Bear et al. |
| 5,396,227 | A | 3/1995 | Carroll et al. |
| 5,396,265 | A | 3/1995 | Ulrich et al. |
| 5,403,238 | A | 4/1995 | Baxter et al. |
| 5,405,294 | A | 4/1995 | Briggs |
| 5,411,269 | A | 5/1995 | Thomas |
| 5,421,590 | A | 6/1995 | Robbins |
| 5,429,361 | A | 7/1995 | Raven et al. |
| 5,430,435 | A | 7/1995 | Hoch |

5,432,864 A 7/1995 Lu et al.
5,435,569 A 7/1995 Zilliox
D360,903 S 8/1995 Barr et al.
5,439,199 A 8/1995 Briggs et al.
5,440,326 A 8/1995 Quinn
5,443,261 A 8/1995 Lee et al.
5,453,053 A 9/1995 Danta et al.
5,453,758 A 9/1995 Sato
D362,870 S 10/1995 Oikawa
5,459,489 A 10/1995 Redford
5,469,194 A 11/1995 Clark et al.
5,481,957 A 1/1996 Paley
5,482,510 A 1/1996 Ishii et al.
5,484,355 A 1/1996 King
5,485,171 A 1/1996 Copper et al.
5,488,362 A 1/1996 Ullman et al.
5,490,058 A 2/1996 Yamasaki
5,498,002 A 3/1996 Gechter
5,502,486 A 3/1996 Ueda
5,506,605 A 4/1996 Paley
5,509,806 A 4/1996 Ellsworth
5,517,183 A 5/1996 Bozeman
5,523,800 A 6/1996 Dudek
5,528,265 A 6/1996 Harrison
5,531,443 A 7/1996 Cruz
5,533,933 A 7/1996 Garnjost et al.
5,550,721 A 8/1996 Rapisarda
5,551,701 A 9/1996 Bouton et al.
5,554,033 A 9/1996 Bizzi et al.
5,554,980 A 9/1996 Hashimoto et al.
5,561,543 A 10/1996 Ogawa
5,563,628 A 10/1996 Stroop
5,569,085 A 10/1996 Igarashi et al.
D375,326 S 11/1996 Yokoi et al.
5,573,011 A 11/1996 Felsing
5,574,479 A 11/1996 Odell
5,579,025 A 11/1996 Itoh
D376,826 S 12/1996 Ashida
5,580,319 A 12/1996 Hamilton
5,581,484 A 12/1996 Prince
5,585,584 A 12/1996 Usa
5,586,767 A 12/1996 Bohland
5,587,558 A 12/1996 Matsushima
5,594,465 A 1/1997 Poulachon
5,598,187 A 1/1997 Ide et al.
5,602,569 A 2/1997 Kato
5,603,658 A 2/1997 Cohen
5,605,505 A 2/1997 Han
5,606,343 A 2/1997 Tsuboyama
5,611,731 A 3/1997 Bouton et al.
5,613,913 A 3/1997 Ikematsu et al.
5,615,132 A 3/1997 Horton
5,621,459 A 4/1997 Ueda
5,623,581 A 4/1997 Attenberg
5,624,117 A 4/1997 Ohkubo et al.
5,627,565 A 5/1997 Morishita et al.
D379,832 S 6/1997 Ashida
5,640,152 A 6/1997 Copper
5,641,288 A 6/1997 Zaenglein, Jr.
5,642,931 A 7/1997 Gappelberg
5,643,087 A 7/1997 Marcus et al.
5,645,077 A 7/1997 Foxlin
5,645,277 A 7/1997 Cheng
5,647,796 A 7/1997 Cohen
5,649,867 A 7/1997 Briggs
5,655,053 A 8/1997 Renie
5,662,525 A 9/1997 Briggs
5,666,138 A 9/1997 Culver
5,667,217 A 9/1997 Kelly et al.
5,667,220 A 9/1997 Cheng
5,670,845 A 9/1997 Grant
5,670,988 A 9/1997 Tickle
5,672,090 A 9/1997 Liu
5,674,128 A 10/1997 Holch et al.
5,676,450 A 10/1997 Sink et al.
5,676,673 A 10/1997 Ferre et al.
5,679,004 A 10/1997 McGowan et al.
5,682,181 A 10/1997 Nguyen et al.
5,685,776 A 11/1997 Stambolic et al.
5,685,778 A 11/1997 Sheldon et al.
5,698,784 A 12/1997 Hotelling et al.
5,701,131 A 12/1997 Kuga
5,702,305 A 12/1997 Norman et al.
5,702,323 A 12/1997 Poulton
5,703,623 A 12/1997 Hall et al.
5,716,216 A 2/1998 O'Loughlin et al.
5,716,281 A 2/1998 Dote
5,724,106 A 3/1998 Autry et al.
5,726,675 A 3/1998 Inoue
5,734,371 A 3/1998 Kaplan
5,734,373 A 3/1998 Rosenberg
5,734,807 A 3/1998 Sumi
D393,884 S 4/1998 Hayami
5,736,970 A 4/1998 Bozeman
5,739,811 A 4/1998 Rosenberg et al.
5,741,182 A 4/1998 Lipps et al.
5,741,189 A 4/1998 Briggs
5,742,331 A 4/1998 Uomori
5,745,226 A 4/1998 Gigioli
D394,264 S 5/1998 Sakamoto et al.
5,746,602 A 5/1998 Kikinis
5,751,273 A 5/1998 Cohen
5,752,880 A 5/1998 Gabai et al.
5,752,882 A 5/1998 Acres et al.
5,757,305 A 5/1998 Xydis
5,757,354 A 5/1998 Kawamura
5,757,360 A 5/1998 Nitta et al.
D395,464 S 6/1998 Shiibashi et al.
5,764,224 A 6/1998 Lilja et al.
5,769,719 A 6/1998 Hsu
5,770,533 A 6/1998 Franchi
5,771,038 A 6/1998 Wang
5,772,508 A 6/1998 Sugita et al.
D396,468 S 7/1998 Schindler et al.
5,775,998 A 7/1998 Ikematsu et al.
5,779,240 A 7/1998 Santella
5,785,317 A 7/1998 Sasaki
5,785,592 A 7/1998 Jacobsen
5,786,626 A 7/1998 Brady et al.
D397,162 S 8/1998 Yokoi et al.
5,791,648 A 8/1998 Hohl
5,794,081 A 8/1998 Itoh
5,796,354 A 8/1998 Cartabiano et al.
5,803,840 A 9/1998 Young
5,806,849 A 9/1998 Rutkowski
5,807,284 A 9/1998 Foxlin
5,810,666 A 9/1998 Mero et al.
5,811,896 A 9/1998 Grad
5,819,206 A 10/1998 Horton et al.
5,820,462 A 10/1998 Yokoi et al.
5,820,471 A 10/1998 Briggs
5,820,472 A 10/1998 Briggs
5,822,713 A 10/1998 Profeta
5,825,298 A 10/1998 Walter
5,825,350 A 10/1998 Case, Jr. et al.
D400,885 S 11/1998 Goto
5,830,065 A 11/1998 Sitrick
5,831,553 A 11/1998 Lenssen et al.
5,833,549 A 11/1998 Zur et al.
5,835,077 A 11/1998 Dao et al.
5,835,156 A 11/1998 Blonstein et al.
5,835,576 A 11/1998 Katz
5,836,817 A 11/1998 Acres et al.
5,838,138 A 11/1998 Henty
5,841,409 A 11/1998 Ishibashi et al.
D402,328 S 12/1998 Ashida
5,850,624 A 12/1998 Gard
5,851,149 A 12/1998 Xidos et al.
5,853,332 A 12/1998 Briggs
5,854,622 A 12/1998 Brannon
5,855,372 A 1/1999 Thiemann
5,855,483 A 1/1999 Collins et al.
D405,071 S 2/1999 Gambaro
5,865,680 A 2/1999 Briggs
5,867,146 A 2/1999 Kim et al.
5,874,941 A 2/1999 Yamada
5,875,257 A 2/1999 Marrin et al.
D407,071 S 3/1999 Keating D407,761 S 4/1999 Barr
5,893,562 A 4/1999 Spector
5,897,437 A 4/1999 Nishiumi
5,898,421 A 4/1999 Quinn
5,900,867 A 5/1999 Schindler et al.
5,901,246 A 5/1999 Hoffberg et al.
5,902,968 A 5/1999 Sato et al.
5,906,542 A 5/1999 Neumann
D410,909 S 6/1999 Tickle
5,908,996 A 6/1999 Litterst et al.
5,911,634 A 6/1999 Nidata et al.
5,912,612 A 6/1999 DeVolpi
5,913,019 A 6/1999 Attenberg
5,913,727 A 6/1999 Ahdoot
5,923,317 A 7/1999 Sayler et al.
5,924,695 A 7/1999 Heykoop
5,929,841 A 7/1999 Fujii
5,929,848 A 7/1999 Albukerk et al.
D412,940 S 8/1999 Kato et al.
5,931,739 A 8/1999 Layer et al.
5,942,969 A 8/1999 Wicks
5,944,533 A 8/1999 Wood
5,946,444 A 8/1999 Evans et al.
5,947,789 A 9/1999 Chan
5,947,868 A 9/1999 Dugan
5,955,713 A 9/1999 Titus
5,955,988 A 9/1999 Blonstein et al.
5,956,035 A 9/1999 Sciammarella et al.
5,961,386 A 10/1999 Sawaguchi
5,963,136 A 10/1999 O'Brien
5,964,660 A 10/1999 James et al.
5,967,898 A 10/1999 Takasaka et al.
5,967,901 A 10/1999 Briggs
5,971,271 A 10/1999 Wynn et al.
5,973,757 A 10/1999 Aubuchon et al.
5,980,254 A 11/1999 Muehle et al.
5,982,352 A 11/1999 Pryor
5,982,356 A 11/1999 Akiyama
5,984,785 A 11/1999 Takeda et al.
5,984,788 A 11/1999 Lebensfeld et al.
5,986,570 A 11/1999 Black et al.
5,986,644 A 11/1999 Herder
5,989,120 A 11/1999 Truchsess
5,991,085 A 11/1999 Rallison et al.
5,996,033 A 11/1999 Chiu-Hao
5,999,168 A 12/1999 Rosenberg
6,001,014 A 12/1999 Ogata
6,001,015 A 12/1999 Nishiumi et al.
6,002,394 A 12/1999 Schein
6,009,458 A 12/1999 Hawkins et al.
D419,199 S 1/2000 Cordell et al.
D419,200 S 1/2000 Ashida
6,010,406 A 1/2000 Kajikawa et al.
6,011,526 A 1/2000 Toyoshima et al.
6,012,984 A 1/2000 Roseman
6,013,007 A 1/2000 Root et al.
6,016,144 A 1/2000 Blonstein
6,019,680 A 2/2000 Cheng
6,020,876 A 2/2000 Rosenberg
6,024,647 A 2/2000 Bennett et al.
6,024,675 A 2/2000 Kashiwaguchi
6,025,830 A 2/2000 Cohen
6,037,882 A 3/2000 Levy
6,044,297 A 3/2000 Sheldon
6,049,823 A 4/2000 Hwang
6,052,083 A 4/2000 Wilson
6,057,788 A 5/2000 Cummings
6,058,342 A 5/2000 Orbach
6,059,576 A 5/2000 Brann
6,060,847 A 5/2000 Hettema et al.
6,066,075 A 5/2000 Poulton
6,069,594 A 5/2000 Barnes et al.
6,072,467 A 6/2000 Walker
6,072,470 A 6/2000 Ishigaki
6,075,443 A 6/2000 Schepps et al.
6,075,575 A 6/2000 Schein et al.
6,076,734 A 6/2000 Dougherty et al.
6,077,106 A 6/2000 Mish
6,078,789 A 6/2000 Bodenmann
6,079,982 A 6/2000 Meader
6,080,063 A 6/2000 Khosla
6,081,819 A 6/2000 Ogino
6,084,315 A 7/2000 Schmitt
6,084,577 A 7/2000 Sato et al.
6,085,805 A 7/2000 Bates
6,087,950 A 7/2000 Capan
6,089,987 A 7/2000 Briggs
D429,718 S 8/2000 Rudolph
6,102,406 A 8/2000 Miles et al.
6,110,039 A 8/2000 Oh
6,110,041 A 8/2000 Walker et al.
6,115,028 A 9/2000 Balakrishnan
6,127,990 A 10/2000 Zwern
6,129,549 A 10/2000 Thompson
6,132,318 A 10/2000 Briggs
6,137,457 A 10/2000 Tokuhashi
D433,381 S 11/2000 Talesfore
6,142,870 A 11/2000 Wada
6,142,876 A 11/2000 Cumbers
6,144,367 A 11/2000 Berstis
6,146,278 A 11/2000 Kobayashi
6,148,100 A 11/2000 Anderson et al.
6,149,490 A 11/2000 Hampton
6,150,947 A 11/2000 Shima
6,154,723 A 11/2000 Cox et al.
6,155,926 A 12/2000 Miyamoto et al.
6,160,405 A 12/2000 Needle
6,160,540 A 12/2000 Fishkin et al.
6,160,986 A 12/2000 Gabai et al.
6,162,122 A 12/2000 Acres et al.
6,162,123 A 12/2000 Woolston
6,162,191 A 12/2000 Foxlin
6,164,808 A 12/2000 Shibata
6,171,190 B1 1/2001 Thanasack et al.
6,174,242 B1 1/2001 Briggs et al.
6,176,837 B1 1/2001 Foxlin
6,181,329 B1 1/2001 Stork et al.
6,183,364 B1 2/2001 Trovato
6,183,365 B1 2/2001 Tonomura et al.
6,184,862 B1 2/2001 Leiper
6,184,863 B1 2/2001 Sibert
6,186,902 B1 2/2001 Briggs
6,191,774 B1 2/2001 Schena
6,196,893 B1 3/2001 Casola et al.
6,198,295 B1 3/2001 Hill
6,198,470 B1 3/2001 Agam et al.
6,198,471 B1 3/2001 Cook
6,200,216 B1 3/2001 Peppel
6,200,219 B1 3/2001 Rudell et al.
6,200,253 B1 3/2001 Nishiumi
6,201,554 B1 3/2001 Lands
6,206,745 B1 3/2001 Gabai et al.
6,206,782 B1 3/2001 Walker et al.
6,210,287 B1 4/2001 Briggs
6,211,861 B1 4/2001 Rosenberg et al.
6,214,155 B1 4/2001 Leighton
6,217,450 B1 4/2001 Meredith
6,217,478 B1 4/2001 Vohmann
6,220,171 B1 4/2001 Hettema et al.
6,220,964 B1 4/2001 Miyamoto
6,220,965 B1 4/2001 Hanna et al.
6,222,522 B1 4/2001 Mathews
D442,998 S 5/2001 Ashida
6,224,486 B1 5/2001 Walker et al.
6,224,491 B1 5/2001 Hiromi et al.
6,225,987 B1 5/2001 Matsuda
6,226,534 B1 5/2001 Aizawa
6,227,966 B1 5/2001 Yokoi
6,231,451 B1 5/2001 Briggs
6,234,803 B1 5/2001 Watkins
6,238,289 B1 5/2001 Sobota et al.
6,238,291 B1 5/2001 Fujimoto et al.
6,239,806 B1 5/2001 Nishiumi et al.
RE37,220 E 6/2001 Rapisarda et al.
6,241,611 B1 6/2001 Takeda et al.
6,243,658 B1 6/2001 Raby
6,244,987 B1 6/2001 Ohsuga et al.
6,245,014 B1 6/2001 Brainard et al.

6,248,019 B1 6/2001 Mudie et al.
6,254,101 B1 7/2001 Young
6,254,394 B1 7/2001 Draper et al.
6,261,180 B1 7/2001 Lebensfeld et al.
6,264,202 B1 7/2001 Briggs
6,264,558 B1 7/2001 Nishiumi et al.
6,265,984 B1 7/2001 Molinaroli
6,267,673 B1 7/2001 Miyamoto et al.
6,273,425 B1 8/2001 Westfall et al.
6,273,819 B1 8/2001 Strauss et al.
6,280,327 B1 8/2001 Leifer et al.
6,280,328 B1 8/2001 Holch et al.
6,283,862 B1 9/2001 Richter
6,283,871 B1 9/2001 Briggs
6,290,565 B1 9/2001 Galyean, III et al.
6,290,566 B1 9/2001 Gabai et al.
6,293,684 B1 9/2001 Riblett
6,297,751 B1 10/2001 Fadavi-Ardekani
6,301,534 B1 10/2001 McDermott
6,302,793 B1 10/2001 Fertitta, III et al.
6,302,796 B1 10/2001 Lebensfeld et al.
6,304,250 B1 10/2001 Yang
6,311,982 B1 11/2001 Lebensfeld et al.
6,315,673 B1 11/2001 Kopera
6,320,495 B1 11/2001 Sporgis
6,322,365 B1 11/2001 Shechter et al.
6,323,614 B1 11/2001 Palazzolo
6,323,654 B1 11/2001 Needle
6,325,718 B1 12/2001 Nishiumi et al.
6,328,648 B1 12/2001 Walker et al.
6,328,650 B1 12/2001 Fukawa et al.
6,329,648 B1 12/2001 Delatorre
6,330,427 B1 12/2001 Tabachnik
6,331,841 B1 12/2001 Tokuhashi
6,331,856 B1 12/2001 VanHook
6,332,840 B1 12/2001 Nishiumi et al.
6,337,954 B1 1/2002 Soshi
6,342,010 B1 1/2002 Slifer
6,346,047 B1 2/2002 Sobota
6,347,993 B1 2/2002 Kondo et al.
6,347,998 B1 2/2002 Yoshitomi et al.
6,350,199 B1 2/2002 Williams et al.
6,352,478 B1 3/2002 Gabai et al.
6,356,867 B1 3/2002 Gabai et al.
6,361,396 B1 3/2002 Snyder
6,361,507 B1 3/2002 Foxlin
D456,410 S 4/2002 Ashida
6,364,735 B1 4/2002 Bristow et al.
6,368,177 B1 4/2002 Gabai et al.
6,369,794 B1 4/2002 Sakurai et al.
6,369,908 B1 4/2002 Frey et al.
6,371,375 B1 4/2002 Ackley et al.
6,371,853 B1 4/2002 Borta
6,375,566 B1 4/2002 Yamada
6,375,569 B1 4/2002 Acres
6,375,572 B1 4/2002 Masuyama et al.
6,375,578 B1 4/2002 Briggs
6,377,793 B1 4/2002 Jenkins
6,377,906 B1 4/2002 Rowe
D456,854 S 5/2002 Ashida
6,383,079 B1 5/2002 Takeda et al.
6,386,538 B1 5/2002 Mejia
6,392,613 B1 5/2002 Goto
6,394,904 B1 5/2002 Stalker
6,400,480 B1 6/2002 Thomas
6,400,996 B1 6/2002 Hoffberg et al.
6,404,409 B1 6/2002 Solomon
6,409,379 B1 6/2002 Gabathuler et al.
6,409,604 B1 6/2002 Matsuno
6,409,687 B1 6/2002 Foxlin
D459,727 S 7/2002 Ashida
D460,787 S 7/2002 Nishikawa
6,414,589 B1 7/2002 Angott et al.
6,415,223 B1 7/2002 Lin
6,421,056 B1 7/2002 Nishiumi
6,424,333 B1 7/2002 Tremblay
6,426,719 B1 7/2002 Nagareda
6,426,741 B1 7/2002 Goldsmith et al.
D462,683 S 9/2002 Ashida
6,445,960 B1 9/2002 Borta
6,452,494 B1 9/2002 Harrison
6,456,276 B1 9/2002 Park
D464,052 S 10/2002 Fletcher
D464,950 S 10/2002 Fraquelli et al.
6,462,769 B1 10/2002 Trowbridge et al.
6,463,257 B1 10/2002 Wood
6,463,859 B1 10/2002 Ikezawa et al.
6,466,198 B1 10/2002 Feinstein
6,466,831 B1 10/2002 Shibata
6,473,713 B1 10/2002 McCall
6,474,159 B1 11/2002 Foxlin et al.
6,482,067 B1 11/2002 Pickens
6,484,080 B2 11/2002 Breed
6,490,409 B1 12/2002 Walker
6,492,981 B1 12/2002 Stork et al.
6,494,457 B2 12/2002 Conte et al.
6,496,122 B2 12/2002 Sampsell
6,509,217 B1 1/2003 Reddy
6,512,511 B2 1/2003 Willner
6,517,438 B2 2/2003 Tosaki
6,518,952 B1 2/2003 Leiper
6,525,660 B1 2/2003 Surintrspanont
6,526,158 B1 2/2003 Goldberg
6,527,646 B1 3/2003 Briggs
6,530,838 B2 3/2003 Ha et al.
6,530,841 B2 3/2003 Bull et al.
6,538,675 B2 3/2003 Aratani
D473,942 S 4/2003 Motoki et al.
6,540,611 B1 4/2003 Nagata
6,544,124 B2 4/2003 Ireland
6,544,126 B2 4/2003 Sawano
6,545,661 B1 4/2003 Goschy et al.
6,551,188 B2 4/2003 Toyama et al.
6,554,707 B1 4/2003 Sinclair et al.
D474,763 S 5/2003 Tozaki et al.
6,565,438 B2 5/2003 Ogino
6,567,536 B2 5/2003 McNitt et al.
6,569,023 B1 5/2003 Briggs
6,572,108 B1 6/2003 Bristow
6,575,753 B2 6/2003 Rosa et al.
6,577,350 B1 6/2003 Proehl
6,579,098 B2 6/2003 Shechter
6,582,380 B2 6/2003 Kazlausky et al.
6,583,783 B1 6/2003 Dietrich
6,585,596 B1 7/2003 Leifer et al.
6,589,120 B1 7/2003 Takahashi
6,590,536 B1 7/2003 Walton
6,591,677 B2 7/2003 Rothoff
6,592,461 B1 7/2003 Raviv et al.
6,595,863 B2 7/2003 Chamberlain et al.
6,597,342 B1 7/2003 Haruta
6,597,443 B2 7/2003 Boman
6,599,194 B1 7/2003 Smith
6,605,038 B1 8/2003 Teller et al.
6,608,563 B2 8/2003 Weston et al.
6,609,969 B1 8/2003 Luciano et al.
6,609,977 B1 8/2003 Shimizu
6,616,452 B2 9/2003 Clark et al.
6,616,535 B1 9/2003 Nishizak
6,616,607 B2 9/2003 Hashimoto
6,626,728 B2 9/2003 Holt
6,628,257 B1 9/2003 Oka
6,629,019 B2 9/2003 Legge et al.
6,632,142 B2 10/2003 Keith
6,633,155 B1 10/2003 Liang
6,634,949 B1 10/2003 Briggs et al.
6,636,826 B1 10/2003 Abe et al.
6,641,482 B2 11/2003 Masuyama et al.
6,650,029 B1 11/2003 Johnston
6,650,313 B2 11/2003 Levine
6,650,345 B1 11/2003 Saito
6,651,268 B1 11/2003 Briggs
6,654,001 B1 11/2003 Su
6,672,962 B1 1/2004 Ozaki et al.
6,676,520 B2 1/2004 Nishiumi et al.
6,676,524 B1 1/2004 Botzas
6,677,990 B1 1/2004 Kawahara
6,681,629 B2 1/2004 Foxlin et al.

6,682,074 B2 1/2004 Weston
6,684,062 B1 1/2004 Gosior et al.
D486,145 S 2/2004 Kaminski et al.
6,686,954 B1 2/2004 Kitaguchi
6,692,170 B2 2/2004 Abir
6,693,622 B1 2/2004 Shahoian et al.
6,702,672 B1 3/2004 Angell et al.
6,709,336 B2 3/2004 Siegel et al.
6,712,692 B2 3/2004 Basson
6,716,102 B2 4/2004 Whitten et al.
6,717,573 B1 4/2004 Shahoian et al.
6,717,673 B1 4/2004 Janssen
6,718,280 B2 4/2004 Hermann
6,725,107 B2 4/2004 MacPherson
6,725,173 B2 4/2004 An
D489,361 S 5/2004 Mori et al.
6,729,934 B1 5/2004 Driscoll et al.
6,733,390 B2 5/2004 Walker et al.
6,736,009 B1 5/2004 Schwabe
6,739,979 B2 5/2004 Tracy
D491,924 S 6/2004 Kaminski et al.
D492,285 S 6/2004 Ombao et al.
6,743,104 B1 6/2004 Ota et al.
6,746,334 B1 6/2004 Barney
6,747,632 B2 6/2004 Howard
6,747,690 B2 6/2004 Molgaard
6,752,719 B2 6/2004 Himoto et al.
6,753,849 B1 6/2004 Curran et al.
6,753,888 B2 6/2004 Kamiwada
6,757,068 B2 6/2004 Foxlin
6,757,446 B1 6/2004 Li
6,761,637 B2 7/2004 Weston et al.
6,765,553 B1 7/2004 Odamura
D495,336 S 8/2004 Andre et al.
6,773,325 B1 8/2004 Mawle et al.
6,773,344 B1 8/2004 Gabai et al.
6,785,539 B2 8/2004 Hale
6,786,830 B2 9/2004 Briggs et al.
6,786,877 B2 9/2004 Foxlin
6,796,177 B2 9/2004 Mori
6,796,908 B2 9/2004 Weston
6,797,895 B2 9/2004 Lapstun
6,811,489 B1 11/2004 Shimizu
6,811,491 B1 11/2004 Levenberg et al.
6,812,881 B1 11/2004 Mullaly et al.
6,813,525 B2 11/2004 Reid
6,813,574 B1 11/2004 Yedur
6,816,151 B2 11/2004 Dellinger
6,821,206 B1 11/2004 Ishida et al.
6,836,705 B2 12/2004 Hellmann
6,836,751 B2 12/2004 Paxton
6,836,971 B1 1/2005 Wang
6,842,991 B2 1/2005 Levi
6,846,238 B2 1/2005 Wells
6,850,221 B1 2/2005 Tickle
6,850,844 B1 2/2005 Walters
6,856,327 B2 2/2005 Choi
D502,468 S 3/2005 Knight et al.
6,868,738 B2 3/2005 Moscrip
6,872,139 B2 3/2005 Sato et al.
6,873,406 B1 3/2005 Hines
D503,750 S 4/2005 Kit et al.
D504,298 S 4/2005 Hedderich et al.
6,878,066 B2 4/2005 Leifer
6,882,824 B2 4/2005 Wood
D504,677 S 5/2005 Kaminski et al.
D505,424 S 5/2005 Ashida et al.
6,890,262 B2 5/2005 Oishi
6,891,526 B2 5/2005 Gombert
6,894,686 B2 5/2005 Stamper et al.
6,897,845 B2 5/2005 Ozawa
6,897,854 B2 5/2005 Cho et al.
6,902,483 B2 6/2005 Lin
6,903,725 B2 6/2005 Nacson
6,905,411 B2 6/2005 Nguyen et al.
6,906,700 B1 6/2005 Armstrong
6,908,386 B2 6/2005 Suzuki et al.
6,908,388 B2 6/2005 Shimizu
6,918,833 B2 7/2005 Emmerson et al.
6,921,332 B2 7/2005 Fukunaga
6,922,632 B2 7/2005 Foxlin
6,925,410 B2 8/2005 Narayanan
6,929,543 B1 8/2005 Ueshima et al.
6,929,548 B2 8/2005 Wang
6,932,698 B2 8/2005 Sprogis
6,932,706 B1 8/2005 Kaminkow
6,933,923 B2 8/2005 Feinstein
6,935,864 B2 8/2005 Shechter et al.
6,939,232 B2 9/2005 Tanaka et al.
6,948,999 B2 9/2005 Chan
6,954,980 B2 10/2005 Song
6,956,564 B1 10/2005 Williams
6,965,374 B2 11/2005 Villet et al.
6,966,775 B1 11/2005 Kendir et al.
6,967,563 B2 11/2005 Bormaster
6,967,566 B2 11/2005 Weston et al.
6,982,697 B2 1/2006 Wilson et al.
6,983,219 B2 1/2006 Mantyjarvi
6,984,208 B2 1/2006 Zheng
6,990,639 B2 1/2006 Wilson
6,995,748 B2 2/2006 Gordon et al.
6,998,966 B2 2/2006 Pedersen
7,000,469 B2 2/2006 Foxlin et al.
7,002,591 B1 2/2006 Leather
7,004,847 B2 2/2006 Henry
7,029,400 B2 4/2006 Briggs
7,031,875 B2 4/2006 Ellenby et al.
7,040,986 B2 5/2006 Koshima
7,040,993 B1 5/2006 Lovitt
7,040,998 B2 5/2006 Jolliffe et al.
7,052,391 B1 5/2006 Luciano, Jr.
7,055,101 B2 5/2006 Abbott et al.
7,066,781 B2 6/2006 Weston
7,081,033 B1 7/2006 Mawle
7,081,051 B2 7/2006 Himoto et al.
7,094,147 B2 8/2006 Nakata
7,098,891 B1 8/2006 Pryor
7,098,894 B2 8/2006 Yang
7,102,616 B1 9/2006 Sleator
7,107,168 B2 9/2006 Oystol
D531,228 S 10/2006 Ashida et al.
7,115,032 B2 10/2006 Cantu et al.
7,118,482 B2 10/2006 Ishihara et al.
7,126,584 B1 10/2006 Nishiumi et al.
7,127,370 B2 10/2006 Kelly
D531,585 S 11/2006 Weitgasser et al.
7,136,826 B2 11/2006 Alsafadi
7,137,899 B2 11/2006 Hiei
7,145,551 B1 12/2006 Bathiche
7,149,627 B2 12/2006 Ockerse
7,154,475 B2 12/2006 Crew
7,158,116 B2 1/2007 Poltorak
7,158,118 B2 1/2007 Liberty
7,173,604 B2 2/2007 Marvit
7,176,919 B2 2/2007 Drebin
7,180,414 B2 2/2007 Nyfelt
7,180,503 B2 2/2007 Burr
7,182,691 B1 2/2007 Schena
7,183,480 B2 2/2007 Nishitani et al.
7,184,059 B1 2/2007 Fouladi
D543,246 S 5/2007 Ashida et al.
7,220,220 B2 5/2007 Stubbs et al.
7,223,173 B2 5/2007 Masuyama et al.
7,231,063 B2 6/2007 Naimark
7,233,316 B2 6/2007 Smith et al.
7,236,156 B2 6/2007 Liberty et al.
7,239,301 B2 7/2007 Liberty et al.
7,261,690 B2 8/2007 Teller et al.
7,262,760 B2 8/2007 Liberty
RE39,818 E 9/2007 Slifer
D556,201 S 11/2007 Ashida et al.
7,291,014 B2 11/2007 Chung et al.
7,297,059 B2 11/2007 Vancura et al.
7,301,527 B2 11/2007 Marvit
7,301,648 B2 11/2007 Foxlin
D556,760 S 12/2007 Ashida et al.
7,307,617 B2 12/2007 Wilson et al.
D559,847 S 1/2008 Ashida et al.

| | | | |
|---|---|---|---|
| D561,178 | S | 2/2008 | Azuma |
| 7,331,857 | B2 | 2/2008 | MacIver |
| 7,335,134 | B1 | 2/2008 | LaVelle |
| D563,948 | S | 3/2008 | d-Hoore |
| 7,339,105 | B2 | 3/2008 | Eitaki |
| 7,345,670 | B2 | 3/2008 | Armstrong |
| D567,243 | S | 4/2008 | Ashida et al. |
| 7,359,451 | B2 | 4/2008 | McKnight |
| 7,361,073 | B2 | 4/2008 | Martin |
| RE40,324 | E | 5/2008 | Crawford |
| 7,379,566 | B2 | 5/2008 | Hildreth |
| 7,387,559 | B2 | 6/2008 | Sanchez-Castro et al. |
| 7,395,181 | B2 | 7/2008 | Foxlin |
| 7,398,151 | B1 | 7/2008 | Burrell et al. |
| 7,414,611 | B2 | 8/2008 | Liberty |
| 7,419,428 | B2 | 9/2008 | Rowe |
| 7,424,388 | B2 | 9/2008 | Sato |
| 7,428,499 | B1 | 9/2008 | Philyaw |
| 7,435,179 | B1 | 10/2008 | Ford |
| 7,441,151 | B2 | 10/2008 | Whitten et al. |
| 7,442,108 | B2 | 10/2008 | Ganz |
| 7,445,550 | B2 | 11/2008 | Barney et al. |
| 7,465,212 | B2 | 12/2008 | Ganz |
| 7,488,231 | B2 | 2/2009 | Weston |
| 7,489,299 | B2 | 2/2009 | Liberty et al. |
| 7,492,268 | B2 | 2/2009 | Ferguson et al. |
| 7,492,367 | B2 | 2/2009 | Mahajan et al. |
| 7,500,917 | B2 | 3/2009 | Barney |
| 7,502,759 | B2 | 3/2009 | Hannigan et al. |
| 7,519,537 | B2 | 4/2009 | Rosenberg |
| 7,524,246 | B2 | 4/2009 | Briggs et al. |
| 7,535,456 | B2 | 5/2009 | Liberty et al. |
| 7,536,156 | B2 | 5/2009 | Tischer |
| 7,564,426 | B2 | 7/2009 | Poor |
| 7,568,289 | B2 | 8/2009 | Burlingham et al. |
| 7,572,191 | B2 | 8/2009 | Weston et al. |
| 7,596,466 | B2 | 9/2009 | Ohta |
| 7,614,958 | B2 | 11/2009 | Weston et al. |
| 7,623,115 | B2 | 11/2009 | Marks |
| 7,627,451 | B2 | 12/2009 | Vock |
| 7,662,015 | B2 | 2/2010 | Hui |
| 7,663,509 | B2 | 2/2010 | Shen |
| 7,674,184 | B2 | 3/2010 | Briggs et al. |
| 7,704,135 | B2 | 4/2010 | Harrison |
| 7,749,089 | B1 | 7/2010 | Briggs et al. |
| 7,774,155 | B2 | 8/2010 | Sato et al. |
| 7,789,741 | B1 | 9/2010 | Fields |
| 7,796,116 | B2 | 9/2010 | Salsman et al. |
| 7,850,527 | B2 | 12/2010 | Barney et al. |
| 7,878,905 | B2 | 2/2011 | Weston et al. |
| 7,883,420 | B2 | 2/2011 | Bradbury |
| 7,896,742 | B2 | 3/2011 | Weston et al. |
| 7,927,216 | B2 | 4/2011 | Ikeda |
| 7,942,745 | B2 | 5/2011 | Ikeda |
| 8,021,239 | B2 | 9/2011 | Weston et al. |
| 2001/0015123 | A1 | 8/2001 | Nishitani et al. |
| 2001/0024973 | A1 | 9/2001 | Meredith |
| 2001/0031662 | A1 | 10/2001 | Larian |
| 2001/0039206 | A1 | 11/2001 | Peppel |
| 2001/0049302 | A1 | 12/2001 | Hagiwara et al. |
| 2001/0054082 | A1 | 12/2001 | Rudolph et al. |
| 2002/0005787 | A1 | 1/2002 | Gabai et al. |
| 2002/0024500 | A1 | 2/2002 | Howard |
| 2002/0028071 | A1 | 3/2002 | Molgaard |
| 2002/0032067 | A1 | 3/2002 | Barney |
| 2002/0038267 | A1 | 3/2002 | Can et al. |
| 2002/0052238 | A1 | 5/2002 | Muroi |
| 2002/0058459 | A1 | 5/2002 | Holt |
| 2002/0068500 | A1 | 6/2002 | Gabai et al. |
| 2002/0072418 | A1 | 6/2002 | Masuyama et al. |
| 2002/0075335 | A1 | 6/2002 | Rekimoto |
| 2002/0090985 | A1 | 7/2002 | Tochner et al. |
| 2002/0090992 | A1 | 7/2002 | Legge et al. |
| 2002/0098887 | A1 | 7/2002 | Himoto et al. |
| 2002/0103026 | A1 | 8/2002 | Himoto et al. |
| 2002/0107591 | A1 | 8/2002 | Gabai et al. |
| 2002/0118147 | A1 | 8/2002 | Solomon |
| 2002/0123377 | A1 | 9/2002 | Shulman |
| 2002/0128056 | A1 | 9/2002 | Kato |
| 2002/0137427 | A1 | 9/2002 | Peters |
| 2002/0137567 | A1 | 9/2002 | Cheng |
| 2002/0140745 | A1 | 10/2002 | Ellenby |
| 2002/0158751 | A1 | 10/2002 | Bormaster |
| 2002/0158843 | A1 | 10/2002 | Levine |
| 2003/0013513 | A1 | 1/2003 | Rowe |
| 2003/0022736 | A1 | 1/2003 | Cass |
| 2003/0027634 | A1 | 2/2003 | Matthews |
| 2003/0036425 | A1 | 2/2003 | Kaminkow et al. |
| 2003/0037075 | A1 | 2/2003 | Hannigan |
| 2003/0038778 | A1 | 2/2003 | Noguera |
| 2003/0052860 | A1 | 3/2003 | Park et al. |
| 2003/0057808 | A1 | 3/2003 | Lee et al. |
| 2003/0063068 | A1 | 4/2003 | Anton |
| 2003/0069077 | A1 | 4/2003 | Korienek |
| 2003/0073505 | A1 | 4/2003 | Tracy |
| 2003/0095101 | A1 | 5/2003 | Jou |
| 2003/0096652 | A1 | 5/2003 | Siegel et al. |
| 2003/0107178 | A1 | 6/2003 | Weston |
| 2003/0107551 | A1 | 6/2003 | Dunker |
| 2003/0134679 | A1 | 7/2003 | Siegel et al. |
| 2003/0144047 | A1 | 7/2003 | Sprogis |
| 2003/0144056 | A1 | 7/2003 | Leifer et al. |
| 2003/0166416 | A1 | 9/2003 | Ogata |
| 2003/0171145 | A1 | 9/2003 | Rowe |
| 2003/0171190 | A1 | 9/2003 | Rice |
| 2003/0190967 | A1 | 10/2003 | Henry |
| 2003/0193572 | A1 | 10/2003 | Wilson et al. |
| 2003/0195037 | A1 | 10/2003 | Vuong et al. |
| 2003/0195041 | A1 | 10/2003 | McCauley |
| 2003/0195046 | A1 | 10/2003 | Bartsch |
| 2003/0204361 | A1 | 10/2003 | Townsend |
| 2003/0216176 | A1 | 11/2003 | Shimizu |
| 2003/0222851 | A1 | 12/2003 | Lai |
| 2003/0234914 | A1 | 12/2003 | Solomon |
| 2004/0028258 | A1 | 2/2004 | Naimark |
| 2004/0033833 | A1 | 2/2004 | Briggs et al. |
| 2004/0034289 | A1 | 2/2004 | Teller et al. |
| 2004/0048666 | A1 | 3/2004 | Bagley |
| 2004/0063480 | A1 | 4/2004 | Wang |
| 2004/0070564 | A1 | 4/2004 | Dawson |
| 2004/0075650 | A1 | 4/2004 | Paul |
| 2004/0081313 | A1 | 4/2004 | McKnight et al. |
| 2004/0095317 | A1 | 5/2004 | Zhang |
| 2004/0102247 | A1 | 5/2004 | Smoot et al. |
| 2004/0119693 | A1 | 6/2004 | Kaemmler |
| 2004/0121834 | A1 | 6/2004 | Libby et al. |
| 2004/0134341 | A1 | 7/2004 | Sandoz |
| 2004/0140954 | A1 | 7/2004 | Faeth |
| 2004/0143413 | A1 | 7/2004 | Oystol |
| 2004/0147317 | A1 | 7/2004 | Ito et al. |
| 2004/0152499 | A1 | 8/2004 | Lind et al. |
| 2004/0152515 | A1 | 8/2004 | Wegmuller et al. |
| 2004/0174287 | A1 | 9/2004 | Deak |
| 2004/0193413 | A1 | 9/2004 | Wilson |
| 2004/0198158 | A1 | 10/2004 | Driscoll et al. |
| 2004/0203638 | A1 | 10/2004 | Chan |
| 2004/0204240 | A1 | 10/2004 | Barney |
| 2004/0218104 | A1 | 11/2004 | Smith |
| 2004/0222969 | A1 | 11/2004 | Buchenrieder |
| 2004/0227725 | A1 | 11/2004 | Calarco |
| 2004/0229693 | A1 | 11/2004 | Lind |
| 2004/0229696 | A1 | 11/2004 | Beck |
| 2004/0236453 | A1 | 11/2004 | Szoboszlay |
| 2004/0239626 | A1 | 12/2004 | Noguera |
| 2004/0259651 | A1 | 12/2004 | Storek |
| 2004/0268393 | A1 | 12/2004 | Hunleth |
| 2005/0017454 | A1 | 1/2005 | Endo et al. |
| 2005/0020369 | A1 | 1/2005 | Davis |
| 2005/0047621 | A1 | 3/2005 | Cranfill |
| 2005/0054457 | A1 | 3/2005 | Eyestone |
| 2005/0059503 | A1 | 3/2005 | Briggs et al. |
| 2005/0060586 | A1 | 3/2005 | Burger |
| 2005/0076161 | A1 | 4/2005 | Albanna |
| 2005/0085298 | A1 | 4/2005 | Woolston |
| 2005/0116020 | A1 | 6/2005 | Smolucha et al. |
| 2005/0125826 | A1 | 6/2005 | Hunleth |
| 2005/0130739 | A1 | 6/2005 | Argentar |
| 2005/0134555 | A1 | 6/2005 | Liao |

2005/0143173 A1 6/2005 Barney et al.
2005/0156883 A1 7/2005 Wilson et al.
2005/0162389 A1 7/2005 Obermeyer
2005/0164601 A1 7/2005 McEachen
2005/0170889 A1 8/2005 Lum et al.
2005/0172734 A1 8/2005 Alsio
2005/0174324 A1 8/2005 Liberty
2005/0176485 A1 8/2005 Ueshima
2005/0179644 A1 8/2005 Alsio
2005/0210418 A1 9/2005 Marvit
2005/0210419 A1 9/2005 Kela
2005/0212749 A1 9/2005 Marvit
2005/0212750 A1 9/2005 Marvit
2005/0212751 A1 9/2005 Marvit
2005/0212752 A1 9/2005 Marvit
2005/0212753 A1 9/2005 Marvit
2005/0212754 A1 9/2005 Marvit
2005/0212755 A1 9/2005 Marvit
2005/0212756 A1 9/2005 Marvit
2005/0212757 A1 9/2005 Marvit
2005/0212758 A1 9/2005 Marvit
2005/0212759 A1 9/2005 Marvit
2005/0212760 A1 9/2005 Marvit
2005/0212764 A1 9/2005 Toba
2005/0212767 A1 9/2005 Marvit
2005/0215295 A1 9/2005 Arneson
2005/0215322 A1 9/2005 Himoto et al.
2005/0217525 A1 10/2005 McClure
2005/0233808 A1 10/2005 Himoto et al.
2005/0239548 A1 10/2005 Ueshima et al.
2005/0243061 A1 11/2005 Liberty
2005/0243062 A1 11/2005 Liberty
2005/0253806 A1 11/2005 Liberty
2005/0256675 A1 11/2005 Kurata
2005/0266907 A1 12/2005 Weston et al.
2005/0277465 A1 12/2005 Whitten et al.
2005/0278741 A1 12/2005 Robarts
2006/0007115 A1 1/2006 Furuhashi
2006/0028446 A1 2/2006 Liberty
2006/0030385 A1 2/2006 Barney et al.
2006/0040720 A1 2/2006 Harrison
2006/0092133 A1 5/2006 Touma
2006/0094502 A1 5/2006 Katayama et al.
2006/0122474 A1 6/2006 Teller et al.
2006/0123146 A1 6/2006 Wu et al.
2006/0148563 A1 7/2006 Yang
2006/0152487 A1 7/2006 Grunnet-Jepsen
2006/0152488 A1 7/2006 Salsman
2006/0152489 A1 7/2006 Sweetser
2006/0154726 A1 7/2006 Weston et al.
2006/0178212 A1 8/2006 Penzias
2006/0205507 A1 9/2006 Ho
2006/0252475 A1 11/2006 Zalewski
2006/0252477 A1 11/2006 Zalewski et al.
2006/0256081 A1 11/2006 Zalewski
2006/0258452 A1 11/2006 Hsu
2006/0264258 A1 11/2006 Zalewski et al.
2006/0264260 A1 11/2006 Zalewski
2006/0267935 A1 11/2006 Corson
2006/0273907 A1 12/2006 Heiman
2006/0282873 A1 12/2006 Zalewski
2006/0284842 A1 12/2006 Poltorak
2006/0287085 A1 12/2006 Mao
2006/0287086 A1 12/2006 Zalewski
2006/0287087 A1 12/2006 Zalewski
2007/0015588 A1 1/2007 Matsumoto et al.
2007/0049374 A1 3/2007 Ikeda et al.
2007/0050597 A1 3/2007 Ikeda et al.
2007/0052177 A1 3/2007 Ikeda et al.
2007/0060391 A1 3/2007 Ikeda et al.
2007/0066394 A1 3/2007 Ikeda et al.
2007/0066396 A1 3/2007 Weston et al.
2007/0072680 A1 3/2007 Ikeda et al.
2007/0091084 A1 4/2007 Ueshima et al.
2007/0093291 A1 4/2007 Hulvey
2007/0159362 A1 7/2007 Shen
2007/0173705 A1 7/2007 Teller et al.
2007/0252815 A1 11/2007 Kuo
2007/0257884 A1 11/2007 Taira
2007/0265075 A1 11/2007 Zalewski
2007/0265076 A1 11/2007 Lin
2008/0014835 A1 1/2008 Weston et al.
2008/0015017 A1 1/2008 Ashida et al.
2008/0039202 A1 2/2008 Sawano et al.
2008/0119270 A1 5/2008 Ohta
2008/0121782 A1 5/2008 Hotelling et al.
2008/0174550 A1 7/2008 Laurila
2008/0183678 A1 7/2008 Weston et al.
2008/0273011 A1 11/2008 Lin
2008/0278445 A1 11/2008 Sweetser
2009/0009294 A1 1/2009 Kupstas
2009/0033621 A1 2/2009 Quinn
2009/0051653 A1 2/2009 Barney et al.
2009/0124165 A1 5/2009 Weston
2009/0156309 A1 6/2009 Weston et al.
2009/0215534 A1 8/2009 Wilson et al.
2009/0305799 A1 12/2009 Weston et al.
2009/0326851 A1 12/2009 Tanenhaus
2010/0056285 A1 3/2010 Weston et al.
2010/0105475 A1 4/2010 Mikhailov
2010/0144436 A1 6/2010 Marks et al.
2010/0273556 A1 10/2010 Briggs et al.
2010/0289744 A1 11/2010 Cohen
2011/0081969 A1 4/2011 Ikeda
2011/0081970 A1 4/2011 Barney et al.
2011/0177853 A1 7/2011 Ueshima
2011/0190052 A1 8/2011 Takeda
2011/0263330 A1 10/2011 Weston et al.
2011/0300941 A1 12/2011 Weston et al.

FOREIGN PATENT DOCUMENTS

CN 1338961 3/2002
CN 1559644 1/2005
DE 3930581 3/1991
DE 19701374 7/1997
DE 19648487 6/1998
DE 19814254 10/1998
DE 19937307 2/2000
DE 10219198 11/2003
EP 0322825 A2 7/1898
EP 0264782 A2 4/1988
EP 0570999 12/1988
EP 0 546 844 6/1993
EP 0835676 4/1998
EP 0848226 6/1998
EP 0852961 7/1998
EP 1279425 1/2003
EP 1293237 3/2003
GB 2244546 12/1991
GB 2310481 8/1997
GB 2319374 5/1998
GB 2388418 11/2003
JP 62-14527 1/1987
JP 63-186687 8/1988
JP 3-210622 9/1991
JP 06-154422 6/1994
JP 06-190144 7/1994
JP H0677387 10/1994
JP 06-308879 11/1994
JP 07-028591 1/1995
JP 07-107573 4/1995
JP 07-115690 5/1995
JP 07-262797 10/1995
JP 07-302148 11/1995
JP 08-152959 6/1996
JP 8-191953 7/1996
JP 08-221187 8/1996
JP 08-335136 12/1996
JP 09-149915 6/1997
JP 09-164273 6/1997
JP 09-34456 7/1997
JP 09-230997 9/1997
JP 09-274534 10/1997
JP 09-319510 12/1997
JP 10-021000 1/1998
JP 10-033831 2/1998
JP 10 043349 A 2/1998
JP 10-099542 4/1998

| | | | |
|---|---|---|---|
| JP | 10-154038 | | 6/1998 |
| JP | 10-235019 | | 9/1998 |
| JP | 10-254614 | | 9/1998 |
| JP | 11-053994 | | 2/1999 |
| JP | 11-099284 | | 4/1999 |
| JP | 11-114223 | | 4/1999 |
| JP | 2000-033184 | | 2/2000 |
| JP | 2000-33184 | | 2/2000 |
| JP | 2000-176150 | | 6/2000 |
| JP | 2000-270237 | | 9/2000 |
| JP | 2000-300839 | | 10/2000 |
| JP | 2000-308756 | | 11/2000 |
| JP | 2000-325653 | | 11/2000 |
| JP | 2001-058484 | | 3/2001 |
| JP | 2001-104643 | | 4/2001 |
| JP | U20009165 | | 4/2001 |
| JP | 2001-175412 | | 6/2001 |
| JP | 2001-251324 | | 9/2001 |
| JP | 2001-265521 | | 9/2001 |
| JP | 2001-306245 | | 11/2001 |
| JP | 2002-007057 | | 1/2002 |
| JP | 2002-062981 | | 2/2002 |
| JP | 03-262677 | | 3/2002 |
| JP | 2002-78969 | | 3/2002 |
| JP | 2002-091692 | | 3/2002 |
| JP | 03-273531 | | 4/2002 |
| JP | 2002-126375 | | 5/2002 |
| JP | 2002-153673 | | 5/2002 |
| JP | 2002-202843 | | 7/2002 |
| JP | 2002-224444 | | 8/2002 |
| JP | 2002-233665 | | 8/2002 |
| JP | 2002-298145 | | 10/2002 |
| JP | 2003-053038 | | 2/2003 |
| JP | 2003-140823 | | 5/2003 |
| JP | 03-422383 | | 6/2003 |
| JP | 2003-208263 | | 7/2003 |
| JP | 2003-236246 | | 8/2003 |
| JP | 2003-325974 | | 11/2003 |
| JP | 2004-062774 | | 2/2004 |
| JP | 03-517482 | | 4/2004 |
| JP | 2004-313429 | | 11/2004 |
| JP | 2004-313492 | | 11/2004 |
| JP | 2005-040493 | | 2/2005 |
| JP | 2005-063230 | | 3/2005 |
| JP | 2006-136694 | | 6/2006 |
| JP | 2007-083024 | | 4/2007 |
| NL | 9300171 | | 8/1994 |
| RU | 2077358 | C1 | 4/1997 |
| RU | 2125853 | | 2/1999 |
| WO | WO 90/07961 | | 7/1990 |
| WO | WO 94/02931 | | 3/1994 |
| WO | WO 95/11730 | A1 | 5/1995 |
| WO | WO 96/14115 | | 5/1996 |
| WO | WO 96/14121 | | 5/1996 |
| WO | PCT/US97/01811 | | 1/1997 |
| WO | WO 97/09101 | | 3/1997 |
| WO | WO 97/12337 | | 4/1997 |
| WO | WO 97/20305 | | 6/1997 |
| WO | WO/97/28864 | | 8/1997 |
| WO | WO 97/32641 | | 9/1997 |
| WO | WO 98/11528 | | 3/1998 |
| WO | WO 98/36400 | | 8/1998 |
| WO | WO 99/58214 | | 11/1999 |
| WO | WO 00/33168 | | 6/2000 |
| WO | WO 00/67863 | | 11/2000 |
| WO | WO 01/87426 | | 11/2001 |
| WO | WO 02/17054 | | 2/2002 |
| WO | WO 02/34345 | | 5/2002 |
| WO | WO 02/47013 | | 6/2002 |
| WO | WO 03/043709 | | 5/2003 |
| WO | WO 03/044743 | | 5/2003 |
| WO | WO 03/107260 | | 12/2003 |

OTHER PUBLICATIONS

"Raise High the 3D Roof Beam: Kids shape these PC games as they go along." By Anne Field, article as featured in Business Week 2001 (Nov. 26, 2001).

"Toy Wand Manufacturer Selects MEMSIC Sensor: Magic Labs cuts costs with MEMSIC sensor" Press Release by MEMSIC, Inc. as featured on www.memsic.com May 2002.

Badler et al; "Multi-Dimensional Input Techniques and Articulated Figure Positioning by Multiple Constraints", Interactive 3D Graphics, Oct. 1986; pp. 151-169.

Cheok et al; "Micro-Accelerometer Based Hardware Interfaces fro Wearable Computer Mixed Reality Applications," 6th International Symposium on Wearable Computers (ISWC'02), 8 pages.

Digital ID Cards The next generation of 'smart' cards will have more than a one-track mind. Wall Street Journal, Jun. 25, 2001.

Mitchel Resnick et al., "Digital Manipulatives: New Toys to Think With," Chi 98; Apr. 1998; pp. 281-287.

R. Borovoy et al., "Things that Blink: Computationally Augmented Name Tags," IBM Systems Journal, vol. 35, No. 3 & 4, 1996; pp. 488-495.

Richard Borovoy et al., "Groupwear: Nametags That Tell About Relationships," Chi 98, Apr. 1998, pp. 329-330.

Tech Designers Rethink Toys: Make Them Fun. Wall Street Journal, Dec. 14, 2001.

Vanessa Colella et al., "Participatory Simulations: Using Computational Objects to Learn about Dynamic Systems," Chi 98; Apr. 1998, pp. 9-10.

"Get Bass," Videogame by Sega, The International Arcade Museum and the KLOV (accessed at http://www.arcade-museum.com/game_detail.php?game_id=7933 on Jul. 29, 2011).

"Glove-based input interfaces" Cyberglove/Cyberforce, http://www.angelfire.com/ca7/mellott124/glove1.htm (accessed on Jul. 29, 2011).

"Harry Potter Magic Spell Challenge," Tiger Electronics, 2001.

"Kirby Tilt 'n' Tumble 2" http://www.unseen64.net/2008/04/08/koro-koro-kirby-2-kirby-tilt-n-tumble-2-gc-unreleased/, Apr. 8, 2008 (accessed on Jul. 29, 2011).

Kirby Tilt 'n' Tumble (GCN-GBA Spaceworld 2001, You Tube Video, uploaded by adonfjv on Sep. 5, 2006 (accessed at http://www.youtube.com/watch?v=5rLhlwp2iGk on Sep. 7, 2011; digital video available upon request).

"MEMS enable smart golf clubs," Small Times, Jan. 6, 2005, accessed at http://dpwsa.electroiq.com/index/display/semiconductors-article-display/269788/articles/small-times/consumer/2005/01/mems-enable-smart-golf-clubs.html on Jul. 29, 2011.

"Miacomet and Interact Announce Agreement to Launch Line of Reel Feel™ Sport Controllers", PR Newswire (May 13, 1999), accessed at http://www.thefreelibarary.com/_print/PrintArticle.aspx?id=54621351 on Sep. 7, 2011.

"212 Series of Decoders" HT12D/HT12F by HOLTEK—Product Specification (Nov. 2002).

"212" Series Encoders HT12A/HT12E by HOLTEK—Product Specification (Apr. 2000).

"Emerald Forest Toys" [online] [retrieved on Sep. 14, 2005], retrieved from Internet <URL:http://www.pathworks.net/print_eft.html>.

"Enchanted Spell-Casting Sorcerers Wand" by Ken Holt as featured on www.inventionconnection.com online advertisement (Dec. 2002).

"Gatemaster Features", internet article, Jul. 9, 1997; http://web.archive.org/web/10070709135000/www.gatemaster.com/gmfeat.htm (accessed on Dec. 11, 2008).

"Micro Tilt Switch" D6B by Omron® Product Specification.

"Nintendo Wii Controller Invented by Americans: Midway Velocity Controller Technology Brief," You Tube Video presentation dated Jun. 28, 2000; uploaded by drjohniefever on Sep. 8, 2007 (accessed at http://www.youtube.com/watch?v=wjLhSrSxFNw on Jun. 30, 2010; digital video available upon request).

"Ollivanders: Makers of Fine Wands." Dec. 2, 2002. [online] [retrieved on Mar. 30,2005], Retrieved from Internet<URL:http//.www.cim.mcgill.edu/ljer/courses/hci/assignments/2002/www.ece.mcgill.ca/%7Eeuryd>.

"The Magic Labs Conjure Wands" as featured on www.magic-lab.com Product Specification Dec. 2002.

"Tilt Switch" by Fuji & Co. as featured on www.fuji-piezo.com online advertisement May 2001.

ACAR, et al., "Experimental evaluation and comparative analysis of commercial variable-capacitance MEMS accelerometers," Journal of Micromechanics and Microengineering, vol. 13 (1), pp. 634-645, May 2003.
Achenbach, "Golfs New Measuring Stick," Golfweek, 1 page., Jun. 11, 2005.
ACT Labs, Miacomet Background, Jan. 27, 2001, http://web.archive.org/web/200101271753/http://www.act-labs.com/ realfeel_background.htm, (accessed on Sep. 7, 2011).
Agard, "Advances in Strapdown Inertial Systems," Agard Lecture Series No. 133, Advisory Group for Aerospace Research and Development, Neuilly-Sur-Seine (France) (1984).
Algrain, "Estimation of 3-D Angular Motion Using Gyroscopes and Linear Accelerometers," IEEE Transactions on Aerospace and Electronic Systems, vol. 27, No. 6, pp. 910-920 (Nov. 1991).
Algrain, et al., "Accelerometer Based Line-of-Sight Stabilization Approach for Pointing and Tracking System," Second IEEE Conference on Control Applications, Sep. 13-16, 1993 Vancouver, B.C.., pp. 159-163 (1993).
Algrain, et al., "Interlaced Kalman Filtering of 3-D Angular Motion Based on Euler's Nonlinear Equations," IEEE Transactions on Aerospace and Electronic Systems, vol. 30, No. 1 (Jan. 1994).
Allen, et al., "Tracking: Beyond 15 Minutes of Thought," SIGGRAPH 2001 Course 11 (2001).
Santiago, "Extended Kalman filtering applied to a full accelerometer strapdown inertial measurement unit," M.S. Thesis, Massachusetts Institute of Technology, Dept. Of Aeronautics and Astronautics, Santiago (1992).
Analog Devices "ADXL202E Low-Cost .+–.2 g Dual-Axis Accelerometer with Duty Cycle Output" (Data Sheet), Rev. A (2000).
Analog Devices "ADXL50 Single Axis Accelerometer" Data Sheet, Rev. B (1996), available at http://www.analog.com/en/obsolete/adx150/products/product.html.
Analog Devices "MicroConverter®, Multichannel 12-Bit ADC with Embedded Flash MCU, ADuC812" Data Sheet (2003), available at http://www.analog.com/static/imported-files/data_sheets/ADUC812.pdf.
Ang, et al., "Design and Implementation of Active Error Canceling in Hand-held Microsurgical Instrument," Paper presented at 2001 IEEE/RSJ International Conference on Intelligent Robots and Systems (2001).
Ang, et al., "Design of All-Accelerometer Inertial Measurement Unit for Tremor Sensing in Hand-held Microsurgical Instrument," Proceedings of the 2003 IEEE International Conference on Robotics & Automation, Sep. 14-19, 2003, Taipei, Taiwan, pp. 1781-1786 (2003).
Ascension Technology, 6D Bird Class B Installation and Operation Guide (2003).
Ator, "Image-Velocity Sensing with Parallel-Slit Reticles," Journal of the Optical Society of America, vol. 53, No. 12, pp. 1416-1422 (Dec. 1963).
Azarbayejani, et al, "Real-Time 3-D Tracking of the Human Body," M.I.T. Media Laboratory Perceptual Computing Section Technical Report No. 374, Appears in Proceedings of Image'Com 96, Bordeaux, France, May 1996.
Azarbayejani, et al., "Visually Controlled Graphics," M.I.T. Media Laboratory Perceptual Computing Section Technical Report No. 374, Appears in IEEE Transactions on Pattern Analysis and Machine Intelligence, vol. 15, No. 6, pp. 602-605 (Jun. 1993).
Azuma et al., "Improving Static and Dynamic Registration in an Optical See-Through HMD," Paper Presented at SIGGRAPH '94 Annual Conference in Orlando, FL (1994).
Azuma et al., "Making Augmented Reality Work Outdoors Requires Hybrid Tracking," Proceedings of the International Workshop on Augmented Reality, San Francisco, CA, Nov. 1, 1998.
Azuma, "Predictive Tracking for Augmented Reality," Ph.D. Dissertation, University of North Carolina at Chapel Hill, Department of Computer Science (1995).
Azuma, et al., "A Frequency-Domain Analysis of Head-Motion Prediction," Paper Presented at SIGGRAPH '95 Annual Conference in Los Angeles, CA (1995).
Azuma, et al., "A motion-stabilized outdoor augmented reality system," Proceedings of IEEE Virtual Reality '99, Houston, TX, Mar. 13-17, 1999, pp. 252-259.
Bachmann et al., "Inertial and Magnetic Posture Tracking for Inserting Humans into Networked Virtual Environments," Virtual Reality Software and Technology archive, Paper Presented at ACM Symposium on Virtual Reality Software and Technology in Banff, Alberta, Canada (2001).
Bachmann et al., "Orientation Tracking for Humans and Robots Using Inertial Sensors" Paper Presented at 199 International Symposium on Computational Intelligence in Robotics & Automation (CIRA '99) (1999).
Bachmann, "Inertial and Magnetic Angle Tracking of Limb Segments for Inserting Humans into Synthetic Environments," Dissertation, Naval Postgraduate School, Monterey, CA (Dec. 2000).
Balakrishnan, "The Rockin' Mouse: Integral 3D Manipulation on a Plane," Published in Proceedings of 1997 ACM Conference on Human Factors in Computing Systems (CHI'97), pp. 311-318, (1997).
Baraff, "An Introduction to Physically Based Modeling: Rigid Body Simulation I—Unconstrained Rigid Body Dynamics," SIGGRAPH 97 Course Notes, Robotics Institute, Carnegie Mellon University (1997).
Radica Legends of the Lake™ Instruction Manual (2003).
Baudisch, et al., "Soap: a Pointing Device that Works in Mid-air," Proc. UIST'06, Oct. 15-18, 2006, Montreux, Switzerland (2006).
BBN Report No. 7661, "Virtual Environment Technology for Training (VETT)," The Virtual Environment and Teleoperator Research Consortium (VETREC), pp. III-A-27 to III-A-40 (Mar. 1992).
Behringer, "Improving the Registration Precision by Visual Horizon Silhouette Matching," Paper presented at First IEEE Workshop on Augmented Reality (1998).
Behringer, "Registration for Outdoor Augmented Reality Applications Using Computer Vision Techniques and Hybrid Sensors," Paper presented at IEEE Virtual Reality (VR '99) Conference in Houston, TX (1999).
BEI Gyrochip™ Model QRS11 Data Sheet, BEI Systron Donner Inertial Division, BEI Technologies, Inc., (Sep. 1998).
Benbasat, "An Inertial Measurement Unit for User Interfaces," Massachusetts Institute of Technology Masters Thesis, (Sep. 2000).
Benbasat, et al., "An Inertial Measurement Framework for Gesture Recognition and Applications," Paper Presented at International Gesture Workshop on Gesture and Sign Languages in Human-Computer Interaction (GW '01), London, UK (2001).
Bhatnagar, "Position trackers for Head Mounted Display systems: A survey" (Technical Report), University of North Carolina at Chapel Hill (Mar. 1993).
Bianchi, "A Tailless Mouse, New cordless Computer Mouse Invented by ArcanaTech," Inc.com, Jun. 1, 1992 (accessed at http://www.inc.com/magazine/19920601/4115.html on Jun. 17, 2010).
Bishop, "The Self-Tracker: A Smart Optical Sensor on Silicon," Ph.D. Dissertation, Univ. Of North Carolina at Chapel Hill (1984).
Skiens, Mike, "Nintendo Announces Wireless GBA Link", Bloomberg, Sep. 25, 2003 (accessed at http://www.nintendoworldreport.com/news/9011).
Bona, et al., "Optimum Reset of Ship's Inertial Navigation System," IEEE Transactions on Aerospace and Electronic Systems, Abstract only (1965) (accessed at http://oai.dtic.mil/oai/oai?verb=getRecord&metadataPrefix=html&identifier=AD0908193 on Jun. 17, 2010).
Borenstein, et al., "Where am I? Sensors and Methods for Mobile Robot Positioning" (1996).
Boser, "3-Axis Accelerometer with Differential Sense Electronics," Berkeley Sensor & Actuator Center, available at http://www.eecs.berkeley.edu/.about.boser/pdf/3axis.pdf (1997),.
Boser, "Accelerometer Design Example: Analog Devices XL-05/5," Berkeley Sensor & Actuator Center, available at http://www.eecs.berkeley.edu/about.boser/pdf/x105.pdf (1996).
Bowman, et al., "An Introduction to 3-D User Interface Design," MIT Presence, vol. 10, No. 1, pp. 96-108 (Feb. 2001).
Britton et al., "Making Nested Rotations Convenient for the User," SIGGRAPH '78 Proceedings of the 5th Annual Conference on Computer Graphics and Interactive Techniques, vol. 12, Issue 3, pp. 222-227 (Aug. 1978).

Britton, "A Methodology for the Ergonomic Design of Interactive Computer Graphic Systems, and its Application to Crystallography" Ph.D. Dissertation, University of North Carolina at Chapel Hill, Dept. of Computer Science (1977).
Brownell, Richard, Review: Peripheral-GameCube-G3 Wireless Controller, gamesarefun.com, Jul. 13, 2003 (accessed at http://www.gamesarefun.com/gamesdb/perireview.php?perireviewid=1 on Jul. 29, 2011).
Buchanan, Levi: "Happy Birthday, Rumble Pak," IGN.com, Apr. 3, 2008 (accessed at http://retro.ign.com/articles/864/864231p1.html on Jul. 29, 2011).
"The Big Ideas Behind Nintendo's Wii," Business Week, Nov. 16, 2006 (accessed at http://www.businessweek.com/technology/content/nov2006/tc20061116_750580.htm on Aug. 31, 2011).
Business Wire, "Feature/Virtual reality glasses that interface to Sega channel,Time Warner, TCI; project announced concurrent with COMDEX," Nov. 14, 1994 (accessed at http://findarticles.com/p/articles/mi_m0EIN/is_1994_Nov_14/ai_15923497/?tag=content;col1 on Jul. 7, 2010).
Business Wire, "Free-space 'Tilt' Game Controller for Sony Playstation Uses Scenix Chip; SX Series IC Processes Spatial Data in Real Time for On-Screen," Dec. 6, 1999 (accessed at http://findarticles.com/p/articles/mi_m0EIN/is_1999_Dec_6/ai_58042965/?tag=content;col1 on Jul. 7, 2010)).
Business Wire, "Logitech MAGELLAN 3D Controller," Apr. 14, 1997 (accessed at http://www.thefreelibrary.com/_/print/PrintArticle.aspx?id=19306114 on Feb. 10, 2011).
Business Wire, "Mind Path Introduces GYROPOINT RF Wireless Remote," Jan. 27, 2000 (accessed at http://www.allbusiness.com/company-activities-management/operations-office/6381880-1.html on Jun. 17, 2010).
Business Wire, "Pegasus' Wireless PenCell Writes on Thin Air with ART's Handwriting Recognition Solutions," Business Editors/High Tech Writers Telecom Israel 2000 Hall 29, Booth 19-20, Nov. 7, 2000 (accessed at http://www.highbeam.com/doc/1G1-66658008.html on Jun. 17, 2010).
Business Wire, "RPI ships low-cost pro HMD Plus 3D Mouse and VR PC graphics card system for CES," Jan. 9, 1995 (accessed at http://www.highbeam.com/doc/1G1-16009561.html on Jun. 17, 2010).
Buxton et al., "A Study in Two-Handed Input," Proceedings of CHI '86, pp. 321-326 (1986) (accessed at http://www.billbuxton.com/2hands.html on Jul. 29, 2011).
Buxton, Bill, "Human input/output devices," In M. Katz (ed.), *Technology Forecast*: 1995, Menlo Park, CA: Price Waterhouse World Firm Technology Center, pp. 49-65 (1994).
Buxton, Bill, A Directory of Sources for Input Technologies (last updated Apr. 19, 2001), http://web.archive.org/web/20010604004849/http://www.billbuxton.com/InputSources.html (accessed on Sep. 8, 2011).
"Imp Coexists With Your Mouse," Byte, p. 255 (Jan. 1994).
Canaday, "R67-26 The Lincoln Wand," IEEE Transactions on Electronic Computers, vol. EC-16, No, 2, p. 240 (Apr. 1967) (downloaded from IEEE Xplore on Jul. 7, 2010).
Caruso et al., "A New Perspective on Magnetic Field Sensing," Sensors Magazine, Dec. 1, 1998 (accessed at http://www.sensorsmag.com/sensors/electric-magnetic/a-new-perspective-magnetic-field-sensing-855 on Jun. 17, 2010).
Caruso et al., "Vehicle Detection and Compass Applications using AMR Magnetic Sensors", Paper presented at 1999 Sensors Expo in Baltimore, Maryland (May 1999), available at http://masters.donntu.edu.ua/2007/kita/gerus/library/amr.pdf.
Caruso, "Application of Magnetoresistive Sensors in Navigation Systems," Sensors and Actuators, SAE SP-1220, pp. 15-21 (Feb. 1997); text of article accessed at http://www.ssec.honeywell.com/position-sensors/datasheets/sae.pdf.
Caruso, "Applications of Magnetic Sensors for Low Cost Compass Systems," Honeywell, SSEC, Paper presented at IEEE 2000 Position Location and Navigation Symposium (2000), accessed at http://www.ssec.honeywell.com/magnetic/datasheets/lowcost.pdf.
Cho et al., "Magic Wand: A Hand-Drawn Gesture Input Device in 3-D Space with Inertial Sensors," Proceedings of the 9th Intl Workshop on Frontiers in Handwriting Recognition (IWFHR-9 2004), IEEE (2004).
Clark, James H., "Three Dimensional Man Machine Interaction," Siggraph '76, Jul. 14-16 Philadelphia, Pennsylvania, 1 page.
Clark, James H., "Designing Surfaces in 3-D," Graphics and Image Processing-Communications of the ACM, Aug. 1976; vol. 19; No. 8; pp. 454-460.
CNET News.com, "Nintendo Wii Swings Into Action," May 25, 2006 (accessed at http://news.cnet.com/2300-1043_3-6070295-4.html on Aug. 5, 2011).
Cooke, et al., "NPSNET: Flight simulation dynamic modeling using quaternions," Presence, vol. 1, No. 4, pp. 404-420, (Jan. 25, 1994).
Crecente, Brian, "Motion Gaming Gains Momentum," kotaku.com, Sep. 17, 2010 (accessed at http://kotaku.com/5640867/motion-gaming-gains-momentum on Aug. 31, 2011).
Cutrone, "Hot products: Gyration GyroPoint Desk, GyroPoint Pro gyroscope-controlled wired and wireless mice," Results from the Comdex Show Floor, Computer Reseller News, Dec. 4, 1995 (accessed from LexisNexis research database on Feb. 17, 2011; see pp. 8 and 9 of reference submitted herewith).
Immersion, "Immersion Ships New Wireless CyberGlove(R) II Hand Motion-Capture Glove; Animators, Designers, and Researchers Gain Enhanced Efficiency and Realism for Animation, Digital Prototyping and Virtual Reality Projects," Business Wire, Dec. 7, 2005 (available at http://ir.immersion.com/releasedetail.cfm?releaseid=181278).
Deering, Michael F. , "HoloSketch A Virtual Reality Sketching Animation Tool," ACM Transactions on Computer-Human Interaction, Sep. 1995; vol. 2, No. 3; pp. 220-238.
Deruyck, et al., "An Electromagnetic Position Sensor," Polhemus Navigation Sciences, Inc., Burlington, VT (Nov. 1973) (Abstract from DTIC Online).
Donelson, et al., "Spatial Management of Information", Proceedings of 1978 ACM SIGGRAPH Conference in Atlanta, Georgia, pp. 203-209 (1978).
Druin, Allison et al., "Robots for Kids: Exploring New Technologies for Learning," Academic Press, 2000; Chap. 1, 27 pages.
Drzymala, Robert E. , et al., "A Feasibility Study Using a Stereo-Optical Camera System to Verify Gamma Knife Treatment Specification," Proceedings of 22nd Annual EMBS International Conference, Jul. 2000; pp. 1486-1489.
Emura, et al., "Sensor Fusion based Measurement of Human Head Motion," 3rd IEEE International Workshop on Robot and Human Communication (1994).
Ewalt, David M., "Nintendo's Wii is a Revolution," Review, Forbes.com, Nov. 13, 2006 (accessed at http://www.forbes.com/2006/11/13/wii-review-ps3-tech-media-cx_de_1113wii.html on Jul. 29, 2011).
Fielder, Lauren "E3 2001: Nintendo unleashes GameCube software, a new Miyamoto game, and more," GameSpot, May 16, 2001 (accessed at http://www.gamespot.com/news/2761390/e3-2001-nintendo-unleashes-gamecube-software-a-new-miyamoto-game-and-more?tag=gallery_summary%3Bstory on Jul. 29, 2011).
Foxlin et al., "An Inertial Head-Orientation Tracker with Automatic Drift Compensation for Use with HMD's," Proceedings of the 1994 Virtual Reality Software and Technology Conference, Aug. 23-26, 1994, Singapore, pp. 159-173.
Foxlin et al., "Miniature 6-DOF Inertial System for Tracking HMDs," SPIE vol. 3362, Helmet and Head-Mounted Displays III, AeroSense 98, Orlando, FL, Apr. 13-14, 1998.
Foxlin et al., "WearTrack: A Self-Referenced Head and Hand Tracker for Wearable Computers and Portable VR," Proceedings of International Symposium on Wearable Computers (ISWC 2000), Oct. 16-18, 2000, Atlanta, GA.
Foxlin, "Head-tracking Relative to a Moving Vehicle or Simulator Platform Using Differential Inertial Sensors," Proceedings of Helmet and Head-Mounted Displays V, SPIE vol. 4021, AeroSense Symposium, Orlando, FL, Apr. 24-25, 2000.
Foxlin, "Inertial Head Tracker Sensor Fusion by a Complementary Separate-bias Kalman Filter," Proceedings of the IEEE 1996 Virtual Reality Annual International Symposium, pp. 185-194, 267 (1996).
Foxlin, "Pedestrian Tracking with Shoe-Mounted Inertial Sensors," IEEE Computer Graphics and Applications, vol. 25, No. 6, pp. 38-46, (2005).
Foxlin, et al., "Constellation™: A Wide-Range Wireless Motion-Tracking System for Augmented Reality and Virtual Set Applications," ACM SIGGRAPH 98, Orlando, Florida, Jul. 19-24, 1998.

Foxlin, et al., "VIS-Tracker: A Wearable Vision-Inertial Self-Tracker," IEEE VR2003, Mar. 22-26, 2003, Los Angeles, CA.
Frankle, "E3 2002: Roll O Rama," Roll-o-Rama GameCube Preview at IGN, May 23, 2002 (accessed at http://cube.ign.com/articles/360/360662p1.html on Sep. 7, 2011).
Friedmann, et al., "Device Synchronization Using an Optimal Linear Filter," S13D '92: Proceedings of the 1992 symposium on Interactive 3D graphics, pp. 57-62.
Friedmann, et al., "Synchronization in virtual realities," M.I.T. Media Lab Vision and Modeling Group Technical Report No. 157, Jan. 1991 To appear in Presence, vol. 1, No. 1, MIT Press, Cambridge, MA (1991).
FrontSide Field Test, "Get This!" Golf Magazine, Jun. 2005, p. 36.
Fuchs, Eric, "Inertial Head-Tracking," MS Thesis, Massachusetts Institute of Technology, Dept. of Electrical Engineering and Computer Science (Sep. 1993).
Furniss, Maureen, "Motion Capture," posted at http://web.mit.edu/m-i-t/articles/index_furniss.html on Dec. 19, 1999; paper presented at the Media in Transition Conference at MIT on Oct. 8, 1999 (accessed on Sep. 8, 2011).
gamecubicle.com News Article, Nintendo WaveBird Controller, http://www.gamecubicle.com/news-Nintendo_gamecube_wavebird_controller.htm, May 14, 2002 (accessed on Aug. 5, 2011).
Geen et al., "New iMEMS® Angular-Rate-Sensing Gyroscope," Analog Dialogue 37-03, pp. 1-3 (2003).
Green, Jonathan, et al., "Camping in the Digital Wilderness: Tents and Flashlights As Interfaces to Virtual Worlds," Chi 2002, Apr. 2002, pp. 780-781.
Grimm, et al., "Real-Time Hybrid Pose Estimation from Vision and Inertial Data," Proceedings of the First Canadian Conference on Computer and Robot Vision (CRV'04), IEEE Computer Society (2004).
Gyration Ultra Cordless Optical Mouse, User Manual, Gyration, Inc., Saratoga, CA (2003).
Gyration, "Gyration MicroGyro 100 Developer Kit Data Sheet," http://web.archive.org/web/19980708122611/www.gyration.com/html/devkit.ht- ml (Jul. 1998).
Gyration, Inc., GyroRemote GP240-01 Professional Series (2003).
Haykin, et al., "Adaptive Tracking of Linear Time-Variant Systems by Extended RLS Algorithms, IEEE Transactions on Signal Processing," vol. 45, No. 5, pp. 1118-1128 (May 1997).
Heath, "Virtual Reality Resource Guide Al Expert," v9 n5 p32(14) (May 1994) (accessed at http://ftp.hitl.washington.edu/scivw-ftp/commercial/VR-Resource-Guide.txt on Jun. 17, 2010).
Hinckley, "Synchronous Gestures for Multiple Persons and Computers," Paper presented at ACM UIST 2003 Symposium on User Interface Software & Technology in Vancouver, BC, Canada (Nov. 2003).
Hinckley, et al., "Sensing Techniques for Mobile Interaction," Proceedings of the 13th Annual ACM Symposium on User Interface Software and Technology (ACM UIST), San Diego, CA, (2000).
Hinckley, et al., "The VideoMouse: A Camera-Based Multi-Degree-of-Freedom Input Device" ACM UIST'99 Symposium on User Interface Software & Technology, CHI Letters vol. 1 No. 1, pp. 103-112 (1999).
Hinckley, Ken "Haptic Issues for Virtual Manipulation," Ph.D. Dissertation University of Virginia, Dept. of Computer Science (1997).
Hinckley, et al., "A Survey of Design Issues in Spatial Input," Paper presented at 7th Annual ACM Symposium on User Interface Software and Technology (1994).
Hoffman, Hunter G., "Physically Touching Virtual Objects Using Tactile Augmentation Enhances the Realism of Virtual Environments," IEEE Virtual Reality Annual International Symposium '98, Atlanta, Georgia, 1998, 5 pages.
Holloway, Richard Lee, "Registration Errors in Augmented Reality Systems," Ph.D. Dissertation, University of North Carolina at Chapel Hill, Dept. of Computer Science (1995).
Zowie Playsets, http://www.piernot.com/proj/zowie/ (accessed on Jul. 29, 2011).
"Wii Mailbag," IGN.com, Jan. 26, 2006 (accessed at http://uk.wii.ign.com/mail/2006-01-26.html on Aug. 31, 2011).
Interfax Press Release, "Tsinghua Tongfang Releases Unique Peripheral Hardware for 3D Gaming," 2002, 1 page.
Intersense, "InterSense InertiaCube2 Manual for Serial Port Model" (2001).
Intersense, "IS-900 Product Technology Brief," http://www.intersense.com/uploadedFiles/Products/White.sub.—Papers/IS900- .sub.—Tech.sub.—Overview.sub.—Enhanced.pdf (1999).
"Interview with Pat Goschy, the "Real" Nintendo Wii Inventor," YouTube video uploaded by agbulls on Jan. 14, 2008 (accessed at http://www.youtube.com/watch?v=oKtZysYGDLE on Feb. 11, 2011; digital video available upon request).
Jacob, "Human-Computer Interaction—Input Devices," ACM Computing Surveys, vol. 28, No. 1, pp. 177-179 (Mar. 1996); link to text of article provided at http://www.cs.tufts.edu/~jacob/papers/.
Jakubowski, et al., "Increasing Effectiveness of Human Hand Tremor Separation Process by Using Higher-Order Statistics," Measurement Science Review, vol. 1, No. 1 (2001).
Ju, et al., "The Challenges of Designing a User Interface for Consumer Interactive Television Consumer Electronics Digest of Technical Papers.," IEEE 1994 International Conference on Volume , Issue , Jun. 21-23, 1994 pp. 114-115 (downloaded from IEEE Xplore on Jul. 13, 2010).
Kessler, et al., "The Simple Virtual Environment Library: an Extensible Framework for Building VE Applications," Presence, MIT Press (2000).
Kohlhase, "NASA Report, The Voyager Neptune travel guide," Jet Propulsion Laboratory Publication 89-24, (Jun. 1989).
Kormos, D.W., et al., "Intraoperative, Real-Time 3-D Digitizer for Neurosurgical Treatment and Planning," IEEE (1993) (Abstract only).
Kuipers, Jack B., "SPASYN—An Electromagnetic Relative Position and Orientation Tracking System," IEEE Transactions on Instrumentation and Measurement, vol. 29, No. 4, pp. 462-466 (Dec. 1980).
Kunz, Andreas M. et al., "Design and Construction of a New Haptic Interface," Proceedings of DETC '00, ASME 2000 Design Engineering Technical Conferences and Computers and Information in Engineering Conference, Baltimore, Maryland, Sep. 10-13, 2000.
La Scala, et al., "Design of an Extended Kalman Filter Frequency Tracker," IEEE Transactions on Signal Processing, vol. 44, No. 3 (Mar. 1996).
Laser Tag: General info: History of Laser Tag, http://lasertag.org/general/history.html (accessed on Mar. 13, 2008; historical dates start on Mar. 1984).
Laser Tag: Lazer Tag Branded Gear; last update Sep. 26, 2006, http://home.comcast.net/~ferret1963/Lazer_Tag_Brand.HTML (accessed on Mar. 13, 2008; historical dates start in 1986).
Lee et al, "Tilta-Pointer: the Free-Space Pointing Device," Princeton COS 436 Project (Fall 2004); retrieved from Google's cache of http://www.milyehuang.com/cos436/project/specs.html on May 27, 2011.
Lee et al., "Two-Dimensional Position Detection System with MEMS Accelerometer for Mouse Applications," Design Automation Conference, 2001, Proceedings, 2001 pp. 852-857, Jun. 2001.
Leganchuk et al., "Manual and Cognitive Benefits of Two-Handed Input: An Experimental Study," ACM Transactions on Computer-Human Interaction, vol. 5, No. 4, pp. 326-259, Dec. 1998.
Liang, et al., "On Temporal-Spatial Realism in the Virtual Reality Environment," ACM 1991 Symposium on User Interface Software and Technology (Nov. 1991).
Liu, et al., "Enhanced Fisher Linear Discriminant Models for Face Recognition," Paper presented at 14th International Conference on Pattern Recognition (ICPR'98), Queensland, Australia (Aug. 1998).
Logitech's WingMan Cordless RumblePad Sets PC Gamers Free, Press Release, Sep. 2, 2001 (accessed at http://www.logitech.com/en-us/172/1373 on Aug. 5, 2011).
Logitech, "Logitech Tracker—Virtual Reality Motion Tracker," downloaded from http://www.vrealities.com/logitech.html on Jun. 18, 2010.
Logitech, Inc. "3D Mouse & Head Tracker Technical Reference Manual," 1992.
Louderback, J. "Nintendo Wii", Reviews by PC Magazine, Nov. 13, 2006 (accessed at http://www.pcmag.com/article/print/193909 on Sep. 8, 2011).

Luinge, et al., "Estimation of orientation with gyroscopes and accelerometers," Proceedings of the First Joint BMES/EMBS Conference, 1999., vol. 2, p. 844 (Oct. 1999).
Luethi, P. et al., "Low Cost Inertial Navigation System" (2000); downloaded from http://www.electronic —engineering.ch/study/ins/ins.html on Jun. 18, 2010.
MacKenzie et al., "A two-ball mouse affords three degrees of freedom," Extended Abstracts of the CHI '97 Conference on Human Factors in Computing Systems, pp. 303-304. New York: ACM (1997).
MacKinlay, "Rapid Controlled Movement Through a Virtual 3D Workspace," ACM SIGGRAPH Computer Graphics archive, vol. 24, No. 4, pp. 171-176 (Aug. 1990).
MacLean, "Designing with Haptic Feedback", Paper presented at IEEE Robotics and Automation (ICRA '2000) Conference in San Francisco, CA, Apr. 22-28, 2000.
Marrin, "Possibilities for the Digital Baton as a General Purpose Gestural Interface," Late-Breaking/Short Talks, Paper presented at CHI 97 Conference in Atlanta Georgia, Mar. 22-27, 1997 (accessed at http://www.sigchi.org/chi97/proceedings/short-talk/tm.htm on Aug. 5, 2011).
Marrin, Teresa et al., "The Digital Baton: A Versatile Performance Instrument," Paper presented at International Computer Music Conference, Thessaloniki, Greece (1997) (text of paper available at http://quod.lib.umich.edu/cgi/p/pod/dod-idx?c=icmc;idno=bbp2372.1997.083).
Marrin, Teresa, "Toward an Understanding of Musical Gesture: Mapping Expressive Intention with the Digital Baton," Masters Thesis, Massachusetts Institute of Technology, Program in Media Arts and Sciences (1996).
Marti et al., "Biopsy navigator: a smart haptic interface for interventional radiological gestures" Proceedings of the Computer Assisted Radiology and Surgery (CARS 2003) Conference, International Congress Series, vol. 1256, pp. 788-793 (2003) (e-copy of text of paper available at http://infoscience.epfl.ch/record/29966/files/CARS03-GM.pdf).
Masliah, "Measuring the Allocation of Control in 6 Degree of Freedom Docking Experiment," Paper presented at SIGCHI Conference on Human Factors in Computing Systems, The Hague, Netherlands (2000).
Maybeck, "Stochastic Models, Estimation and Control," vol. 1, Chapter 1, Introduction (1979).
Merians, et al., "Virtual Reality-Augmented Rehabilitation for Patients Following Stroke," Physical Therapy, vol. 82, No. 9, Sep. 2002.
Merrill, "FlexiGesture: A sensor-rich real-time adaptive gesture and affordance learning platform for electronic music control," Thesis, Massachusetts Institute of Technology, Jun. 2004.
Meyer et al., "A Survey of Position Tracker," vol. 1, Issue 2, pp. 173-200, MIT Presence, (1992).
Miller, Ross, "Joystiq interview: Patrick Goschy talks about Midway, tells us he 'made the Wii'," Joystiq.com, Jan. 16, 2008 (accessed at http://www.joystiq.com/2008/01/16/joystiq-interview-patrick-goschy-talks-about-midway-tells-us-h/ on Aug. 31, 2011).
Miller, Paul, "Exclusive shots of Goschy's prototype 'Wiimote' controllers," Engadget, Jan. 15, 2008 (accessed at http://www.engadget.com/2008/01/15/exclusive-shots-of-goschys-prototype-wiimote-controllers/ on Aug. 31, 2011).
Morris, "Accelerometry—a technique for the measurement of human body movements," J Biomechanics vol. 6, pp. 729-736 (1973).
Mulder, "Human movement tracking technology," Technical Report, NSERC Hand Centered Studies of Human Movement project, available through anonymous ftp in fas.sfu.ca:/pub/cs/graphics/vmi/HMTT.pub.ps. Z., Burnab, B.C, Canada: Simon Fraser University (Jul. 1994).
Myers et al., "Interacting at a Distance: Measuring the Performance of Laser Pointers and Other Devices," CHI 2002, Apr. 2002.
"The N.I.C.E. Project," YouTube video uploaded by evltube on Nov. 20, 2007 (accessed at http://www.youtube.com/watch?v=ihGXa21qLms on Sep. 8, 2011; digital video available upon request).
Naimark et al., "Circular Data Matrix Fiducial System and Robust Image Processing for a Wearable Vision-Inertial Self-Tracker," IEEE International Symposium on Mixed and Augmented Reality (ISMAR 2002), Darmstadt, Germany (2002).
Naimark, et al., "Encoded LED System for Optical Trackers," Paper presented at Fourth IEEE and ACM International Symposium on Mixed and Augmented Reality (ISMAR 2005), Oct. 5-8, 2005, Vienna Austria (electronic version of text of paper available for download at http://www.intersense.com/pages/44/129/.
Navarrete, et al., "Eigenspace-based Recognition of Faces: Comparisons and a new Approach," Paper Presented at 1$^{th}$ International Conference on Image Analysis and Processing (2001).
New Strait Times Press Release, "Microsoft's New Titles," 1998, 1 page.
News Article, "New Game Controllers Using Analog Devices' G-Force Tilt to be Featured at E3", Norwood, MA (May 10, 1999) (accessed at http://www.thefreelibrary.com/__/print/PrintArticle.aspx?id=54592268 on Jun. 17, 2010).
PR Newswire, "Five New Retailers to Carry Gyration's Gyropoint Point and Gyropoint Pro," Jul. 8, 1996 (accessed at http://www.thefreelibrary.com/__/print/PrintArticle.aspx?id=54592268 on Jun. 18, 2010).
Nintendo Tilt Controller Ad, Electronic Gaming Monthly, 1994, 1 page.
Nintendo, Game Boy Advance SP System Instruction Booklet (2003).
Nintendo, Nintendo Game Boy Advance System Instruction Booklet (2001-2003).
Nintendo, Nintendo Game Boy Advance Wireless Adapter.
Nishiyama, "A Nonlinear Filter for Estimating a Sinusoidal Signal and its Parameters in White Noise: On the Case of a Single Sinusoid," IEEE Transactions on Signal Processing, vol. 45, No, 4, pp. 970-981 (Apr. 1997).
Nishiyama, "Robust Estimation of a Single Complex Sinusoid in White Noise-H., Filtering Approach," IEEE Transactions on Signal Processing, vol. 47, No. 10, pp. 2853-2856 (Oct. 1999).
Odell, "An Optical Pointer for Infrared Remote Controllers," (1995) (downloaded from IEEE Xplore on Jul. 7, 2010).
Ojeda, et al., "No GPS? No Problem!" University of Michigan Develops Award-Winning Personal Dead-Reckoning (PDR) System for Walking Users, available at http://www.engine.umich.edu/research/mrl/urpr/In_Press/P135.pdf, (2004 or later).
Omelyan, "On the numerical integration of motion for rigid polyatomics: The modified quaternion approach" Computers in Physics, vol. 12 No. 1, pp. 97-103 (1998).
Ovaska, "Angular Acceleration Measurement: A Review," Paper presented at IEEE Instrumentation and Measurement Technology Conference, St. Paul, MN, May 18-21, 1998.
Pai, et al., "The Tango: A Tangible Tangoreceptive Whole-Hand Interface," Paper presented at Joint Eurohaptics and IEEE Symposium on Haptic Interfaces for Virtual Environment and Teleoperator Systems, Pisa, Italy, Mar. 18-20, 2005.
Pajama Sam: No Need To Hide When It's Dark Outside Infogames, Sep. 6, 2002.
Park, Adaptive control strategies for MEMS gyroscopes (Dissertation), Univ. Cal. Berkley (Dec. 2000).
PC World, "The 20 Most Innovative Products of the Year," Dec. 27, 2006 (accessed at http://www.pcworld.com/printable/article/id,128176/printable.html on Aug. 2, 2011).
PCTracker, Technical Overview, available at http://www.est-kl.com/fileadmin/media/pdf/InterSense/PCTracker__Tech__Overview.pdf.
Perry, Simon, "Nintendo to Launch Wireless Game Boy Adaptor," Digital Lifestyles, http://digital-lifestyles.info/2003/09/26/Nintendo-to-launch-wireless-game-boy-adaptor/, Sep. 26, 2003 (accessed on Jul. 29, 2011).
Phillips, "TECHWATCH: On the Right Track: A unique optical tracking system gives users greater freedom to explore virtual worlds," Computer Graphics World, vol. 23, Issue 4 (Apr. 2000).
Phillips, "Forward/Up Directional Incompatibilities During Cursor Placement Within Graphical User Interfaces," Ergonomics, vol. 48, No. 6, May 15, 2005.
Phillips, "LPC2104/2105/2106, Single-chip 32-bit microcontrollers; 128 kB ISP/IAP Flash with 64 kB/32 kB/16 kB RAM," Dec. 22, 2004.

Pierce et al., "Image Plane Interaction Techniques in 3D Immersive Environments," Paper presented at 1997 symposium on Interactive 3D graphics, Providence, RI (1997).
Pilcher, "AirMouse Remote Controls," IEEE Conference on Consumer Electronics (1992).
Pique, "Semantics of Interactive Rotations," Interactive 3D Graphics, Proceedings of the 1986 workshop on Interactive 3D graphics, pp. 259-269 (Oct. 1986).
Piyabongkarn, "The Development of a MEMS Gyroscope For Absolute Angle Measurement," Dissertation, Univ. Minnesota, Nov. 2004 (Abstract only).
Polhemus, "Polhemus 3Space Fastrak devices" (image) (2001).
PowerGlove product Program Guide, Mattel, 1989 (Text of Program Guide provided from http://hiwaay.net/~lkseitz/cvtg/power_glove.shtml; the text was typed in by Lee K. Sietz; document created Aug. 25, 1988; accessed on Aug. 2, 2011).
Pryor et al., "A Reusable Software Architecture for Manual Controller Integration," IEEE Conf. on Robotics and Automation, Univ of Texas, pp. 3583-3588 (Apr. 1997).
Raab, et al., "Magnetic Position and Orientation Tracking System," IEEE Transactions on Aerospace and Electronic Systems, vol. AES-15, No. 5, pp. 709-718 (Sep. 1979).
Regan, "Smart Golf Clubs," baltimoresun.com, Jun. 17, 2005.
Rekimoto, "Tilting Operations for Small Screen Interfaces," Tech Note presented at 9th Annual ACM Symposium on User Interface Software and Technology (UIST'96) (1996) (available for download at http://www.sonycsl.co.jp/person/rekimoto/papers/uist96.pdf).
Ribo, et al., "Hybrid Tracking for Outdoor Augmented Reality Applications," IEEE Computer Graphics and Applications, vol. 22, No. 6, pp. 54-63, Nov./Dec. 02.
Riviere, et al., "Adaptive Canceling of Physiological Tremor for Improved Precision in Microsurgery," IEEE Transactions on Biomedical Engineering, vol. 45, No. 7, pp. 839-846 (Jul. 1998).
Robbinett et al., "Implementation of Flying, Scaling, and Grabbing in Virtual Worlds," ACM Symposium (1992).
Roberts, "The Lincoln Wand," 1966 Proceedings of the Fall Joint Computer Conference (1966), available for electronic download at http://www.computer.org/portal/web/csdl/doi/10.1109/AFIPS.1966.105.
Robinett et al., "The Visual Display Transformation for Virtual Reality," University of North Carolina at Chapel Hill (1994).
Roetenberg, "Inertial and magnetic sensing of human motion," Thesis, University of Twente (2006).
Roetenberg, et al., "Inertial And Magnetic Sensing Of Human Movement Near Ferromagnetic Materials," Paper presented at Second IEEE and ACM International Symposium on Mixed and Augmented Reality, Mar. 2003 (available at http://www.xsens.com/images/stories/PDF/Inertial%20and%20magnetic%20sensing%20of%20human%20movement%20near%20ferromagnetic%20materials.pdf.
Rolland, et al., "A Survey of Tracking Technology for Virtual Environments," University of Central Florida, Center for Research and Education in Optics Lasers (CREOL) (2001 ).
Rothman, Wilson, "Unearthed: Nintendo's Pre-Wiimote Prototype," gizmodo.com, Aug. 29, 2007 (accessed at http://gizmodo.com/gadgets/exclusive/unearthed-nintendo-2001-prototype-motion+sensing-one+handed-controller-by-gyration-294642.php on Aug. 31, 2011).
Rothman, Wilson, "Wii-mote Prototype Designer Speaks Out, Shares Sketchbook," Gizmodo.com, Aug. 30, 2007 (accessed at http://gizmodo.com/gadgets/exclusive/wii+mote-prototype-designer-speaks-out-shares-sketchbook-295276.php on Aug. 31, 2011).
Sakai, et al., "Optical Spatial Filter Sensor for Ground Speed," Optical Review, vol. 2, No. 1, pp. 65-67 (1995).
Satterfield, Shane, "E3 2002: Nintendo announces new GameCube games," GameSpot, http://www.gamespot.com/gamecube/action/rollorama/news/2866974/e3-2002-nintendo-announces-new-gamecube-games, May 21, 2002 (accessed on Aug. 11, 2011).
Sawada, et al., "A Wearable Attitude-Measurement System Using a Fiberoptic Gyroscope," MIT Presence, vol. 11, No. 2, pp. 109-118, Apr. 2002.
Saxena, et al., "In Use Parameter Estimation of Inertial Sensors by Detecting Multilevel Quasi-Static States," Berlin: Springer-Verlag, pp. 595-601 (2005).
Schofield, Jack et al., Games reviews, "Coming up for airpad," The Guardian (Feb. 3, 2000) (accessed at http://www.guardian.co.uk/technology/2000/feb/03/online supplement5/print on Jun. 18, 2010).
Selectech Airmouse, "Mighty Mouse", Electronics Today International, p. 11 (Sep. 1990).
Shoemake, Ken, "Quaternions," available online at http://campar.in.tum.de/twiki/pub/Chair/DwarfTutorial/quatut.pdf.
Smartswing, "SmartSwing: Intellegent Golf Clubs that Build a Better Swing," http://web.archive.org/web/20040728221951/http://www.smartswinggolf.com/ (accessed on Sep. 8, 2011).
Smartswing, "The SmartSwing Learning System Overview," Apr. 26, 2004, http://web.archive.org/web/2004426215355/http://www.smartswinggolf.com/tls/index.html (accessed on Jul. 29, 2011).
Smartswing, "The SmartSwing Learning System: How it Works," 3 pages, Apr. 26, 2004, http://web.archive.org/web/20040426213631/http://www.smartswinggolf.com/tls/how_it_works. html (accessed on Jul. 29, 2011).
Smartswing, "The SmartSwing Product Technical Product: Technical Information," Apr. 26, 2004, http://web.archive.org/web/20040426174854/http://www.smartswinggolf.com/products/technical_info.html (accessed on Jul. 29, 2011).
Sorenson, et al., "The Minnesota Scanner: A Prototype Sensor for Three-Dimensional Tracking of Moving Body Segments," IEEE Transactions on Robotics and Animation, vol. 5, No. 4 (Aug. 1989).
Stovall, "Basic Inertial Navigation," NAWCWPNS TM 8128, Navigation and Data Link Section, Systems Integration Branch (Sep. 1997).
Sulic, "Logitech Wingman Cordless Rumblepad Review," Gear Review at IGN, Jan. 14, 2002 (accessed at http://gear.ign.com/articles/317/317472p1.html on Aug. 1, 2011).
Sutherland, "A Head-Mounted Three Dimensional Display," Paper presented at AFIPS '68 Fall Joint Computer Conference, Dec. 9-11, 1968, (1968); paper available at www.cise.ufl.edu/~lok/teaching/dcvef05/papers/sutherland-headmount.pdf.
Sutherland, Ivan E., "Sketchpad: A Man-Machine Graphical Communication System," Proceedings of the AFIPS Spring Joint Computer Conference, Detroit, Michigan, May 21-23, 1963, pp. 329-346 (source provided is reprinting of text accessed at http://www.guidebookgallery.org/articles/sketchpadamanmachinegraphicalcommunicationsystem on Sep. 8, 2011).
Timmer, "Modeling Noisy Time Series: Physiological Tremor," International Journal of Bifurcation and Chaos, vol. 8, No. 7 (1998).
Timmer, et al, "Pathological Tremors: Deterministic Chaos or Nonlinear Stochastic Oscillators?" Chaos, vol. 10, No. 1 pp. 278-288 (Mar. 2000).
Timmer, et al., "Characteristics of Hand Tremor Time Series," Biological Cybernetics, vol. 70, No. 1, pp. 75-80 (1993).
Timmer, et al., "Cross-Spectral Analysis of Tremor Time Series," International Journal of Bifurcation and Chaos, vol. 10, No. 11 pp. 2595-2610 (2000); text available at http://www.fdmold.uni-freiburg.de/groups/timeseries/tremor/pubs/cs_review.pdf.
Timmer, et al., Cross-Spectral Analysis of Physiological Tremor and Muscle Activity: II Application to Synchronized Electromyogram, Biological Cybernetics, vol. 78 (1998) (obtained from http://arxiv.org/abs/chao-dyn/9805012).
Titterton et al., "Strapdown Inertial Navigation Technology," Peter Peregrinus Ltd., pp. 1-56 and pp. 292-321 (1997).
Toy Designers Use Technology in New Ways as Sector Matures, WSJ.com, Dec. 17, 2001.
Ulanoff, Lance, "Nintendo's Wii is the Best Product Ever," PC Magazine, Jun. 21, 2007 (accessed at http://www.pcmag.com/print_article2/0,1217,a=210070,00.asp?hidPrint=true on Aug. 1, 2011).
UNC Computer Science Department, "News & Notes from Sitterson Hall," UNC Computer Science, Department Newsletter, Issue 24, Spring 1999 (Apr. 1999) (accessed at http://www.cs.unc.edu/NewsAndNotes/Issue24/ on Jun. 18, 2010).
Urban, "BAA 96-37 Proposer Information," DARPA/ETO (1996) (accessed at http://www.fbodaily.com/cbd/archive/1996/08(August)/19-Aug-1996/Aso1001.htm on Jul. 27, 2010).

Van Laerhoven et al., "Using an Autonomous Cube for Basic Navigation and Input," Proceedings of the 5th International Conference on Multimodal interfaces, Vancouver, British Columbia, Canada, pp. 203-210, Nov. 5-7, 2003.
Van Rheeden, et al., "Noise Effects on Centroid Tracker Aim Point Estimation," IEEE Trans. On Aerospace and Electronic Systems, vol. 24, No. 2, pp. 177-185 (Mar. 1988).
Vaz, et al., "An Adaptive Estimation of Periodic Signals Using a Fourier Linear Combiner," IEEE Transactions on Signal Processing, vol. 42, No. 1, pp. 1-10 (Jan. 1994).
Verplaetse, "Inertial Proprioceptive Devices: Self-Motion Sensing Toys and Tools," IBM Systems Journal, vol. 35, Nos. 3&4 (Sep. 1996).
Verplaetse, "Inertial-Optical Motion-Estimating Camera for Electronic Cinematography," Masters Thesis, MIT, Media Arts and Sciences (1997).
Villoria, Gerald, "Hands on Roll-O-Rama Game Cube," Game Spot, http://www.gamespot.com/gamecube/action/rollorama/news.html?sid=2868421&com_act=convert&om_clk=newsfeatures&tag=newsfeatures;title;1&m, May 29, 2002 (accessed on Jul. 29, 2011).
Vti, Mindflux-Vti CyberTouch, http://www.mindflux.com/au/products/vti/cybertouch.html (1996).
Wang, et al., "Tracking a Head-Mounted Display in a Room-Sized Environment with Head-Mounted Cameras," Paper presented at SPIE 1990 Technical Symposium on Optical Engineering and Photonics in Aerospace Sensing (1990).
Ward, et al., "A Demonstrated Optical Tracker With Scalable Work Area for Head-Mounted Display Systems," Paper presented at 1992 Symposium on Interactive 3D Graphics (1992).
Watt, Alan, 3D Computer Graphics, Chapter 1: "Mathematical fundamentals of computer graphics," 3rd ed. Addison-Wesley, pp. 1-26 (2000).
Welch et al., "Complementary Tracking and Two-Handed Interaction for Remote 3D Medical Consultation with a PDA," Paper presented at Trends and Issues in Tracking for Virtual Environments Workshop at IEEE Virtual Reality 2007 Conference, available at http://www.cs.unc.edu/~welch/media/pdf/Welch2007_TwoHanded.pdf.
Welch, "Hawkeye Zooms in on Mac Screens with Wireless Infrared Penlight Pointer," MacWeek, May 3, 1993 (excerpt of article accessed at http://www.accessmylibrary.com/article/print/1G1-13785387 on Jun. 18, 2010).
Welch, "Hybrid Self-Tracker: An Inertial/Optical Hybrid Three-Dimensional Tracking System," Tech. Report TR95-048, Dissertation Proposal, Univ. Of North Carolina at Chapel Hill, Dept. Computer Science, Chapel Hill, N.C. (1995).
Welch, et al., "High-Performance Wide-Area Optical Tracking: *The HiBall Tracking System*," MIT Presence: Teleoperators & Virtual Environments (Feb. 2001).
Welch, et al., "SCAAT: Incremental Tracking with Incomplete Information," Paper presented at SIGGRAPH 97 Conference on Computer Graphics and Interactive Techniques (1997), available at http://www.cs.unc.edu/~welch/media/pdf/scaat.pdf.
Welch, et al., "The HiBall Tracker: High-Performance Wide-Area Tracking for Virtual and Augmented Environments," Paper presented at 1999 Symposium on Virtual Reality Software and Technology in London, Dec. 20-22, 1999, available at http://www.cs.unc.edu/~welch/media/pdf/VRST99_HiBall.pdf..
Widrow, et al., "Fundamental Relations Between the LMS Algorithm and the DFT," IEEE Transactions on Circuits and Systems, vol. CAS-34, No. 7 (Jul. 1987).
Wiley, M., "Nintendo Wavebird Review," Jun. 11, 2002, http://gear.ign.com/articles/361/361933p1.html (accessed on Aug. 1, 2011).
Williams, et al., "Physical Presence: Palettes in Virtual Spaces," Society of Photo-Optical Instrumentation Engineers (SPIE) Conference Series, vol. 3639, No. 374-384 (May 1999), available at http://www.fakespacelabs.com/papers/3639_46_LOCAL.pdf.
Wilson, "Wireless User Interface Devices for Connected Intelligent Environments," http://research.microsoft.com/en-us/um/people/awilson/publications/old/ubicomp%202003.pdf (2003).
Wilson "WorldCursor: Pointing in Intelligent Environments with the World Cursor," http://www.acm.org/uist/archive/adjunct/2003/pdf/demos/d4-wilson.pdf (2003).
Wilson et al., "Demonstration of the Xwand Interface for Intelligent Spaces," UIST '02 Companion, pp. 37-38 (2002).
Wilson et al., "Gesture Recognition Using the Xwand," http://www.ri.cmu.edu/pub_files/pub4/wilson_daniel_h_2004_1/wilson_daniel_h_2004_1.pdf (2004).
Wilson et al., "Xwand: UI for Intelligent Spaces," Paper presented at CHI 2003 Conference, Ft. Lauderdale, FL, Apr. 5-10, 2003, available at http://research.microsoft.com/en-us/um/people/awilson/publications/WilsonCHI2003/CHI%202003%20XWand.pdf (2003).
Wormell et al., "Advancements in 3D Interactive Devices for Virtual Environments," Presented at the Joint International Immersive Projection Technologies (IPT)/Eurographics Workshop on Virtual Environments (EGVE) 2003 Workshop, Zurich, Switzerland, May 22-23, 2003 (available for download at http://www.intersense.com/pages/44/123/) (2003).
Wormell, "Unified Camera, Content and Talent Tracking in Digital Television and Movie Production," Presented at NAB 2000, Las Vegas, NV, Apr. 8-13, 2000 (available for download at http://www.intersense.com/pages/44/116/) (2003).
Worringham, et al., "Directional Stimulus-Response Compatibility: A Test of Three Alternative Principles," Ergonomics, vol. 41, Issue 6, pp. 864-880 (Jun. 1998).
You, et al., "Hybrid Inertial and Vision Tracking for Augmented Reality Registration," http://graphics.usc.edu/cgit/pdf/papers/Vr1999.PDF (1999).
You, et al., "Orientation Tracking for Outdoor Augmented Reality Registration," IEE Computer Graphics and Applications, IEEE, vol. 19, No. 6, pp. 36-42 (Nov. 1999).
Youngblut, et al., "Review of Virtual Environment Interface Technology," Institute for Defense Analyses (Mar. 1996).
Zhai, "Human Performance in Six Degree of Freedom Input Control," Ph.D. Thesis, University of Toronto (1995).
U.S. Appl. No. 60/730,659 to Marks et al., filed Oct. 25, 2005.
Boulanger et al., "The 1997 Mathews Radio-Baton and Improvisation Modes," Music Synthesis Department, Berklee College of Music (1997).
Exintaris, et al., "0llivander's Magic Wands : HCI Development," available at http://www.cim.mcgill.ca/~jer/courses/hci/project/2002/www.ece.mcgill.ca/%257Eeurydice/hci/notebook/final/MagicWand.pdf (2002).
Paradiso, et al., "Musical Applications of Electric Field Sensing", available at http://pubs.media.mit.edu/pubs/papers/96_04_cmj.pdf (1996).
U.S. Appl. No. 60/214,317, filed Jun. 27, 2000.
Response to Office Action dated Sep. 18, 2009 for U.S. Appl. No. 11/404,844.
Expert Report of Nathaniel Polish, Ph.D. on Behalf of Respondents Nintendo of America, Inc. and Nintendo Co., Ltd., dated Nov. 3, 2011.
Expert Report of Kenneth Holt on Behalf of Respondents Nintendo of America, Inc. and Nintendo Co., Ltd., dated Nov. 3, 2011.
Respondents Nintendo Co., Ltd. and Nintendo of America Inc.'s Objections and Supplemental Responses to Complainants Creative Kingdoms, LLC and New Kindoms, LLC's Interrogatory Nos. 35, 44, 47, 53, and 78, dated Oct. 13, 2011.

HARVEST QUEST CONSOLE
"Simple, Repair & Bug Reader"
1. Push button to activate reader.
2A. Light lights up.
2B. Place card on reader for points.
2C. Read display for points.

INTERACTIVE PLAY DEVICES FOR WATER PLAY ATTRACTIONS

RELATED APPLICATIONS

This application is a continuation of U.S. patent application Ser. No. 11/406,521, filed Apr. 18, 2006, which is a continuation-in-part of and claims benefit of priority under 35 U.S.C. §120 from U.S. patent application Ser. No. 10/632,556, filed Aug. 1, 2003, now U.S. Pat. No. 7,029,400, issued Apr. 18, 2006, which claims priority under 35 U.S.C. §119(e) to U.S. Provisional Patent Application No. 60/400,430, filed Aug. 1, 2002, each of which is hereby incorporated herein by reference in its entirety to be considered as part of this specification.

FIELD OF THE INVENTION

The present invention relates to interactive attractions and games and, in particular, to interactive water play attractions utilizing electronically-identifiable objects or tags to provide a unique interactive water play experience.

DESCRIPTION OF THE RELATED ART

The popularity of family-oriented theme parks and commercial recreational facilities has increased steadily in recent years. Water parks, in particular, have proliferated as adults and children alike seek the thrill and entertainment of water attractions as a healthy and enjoyable way to cool off during the hot summer months. For example, water parks typically incorporate a variety of different water attractions, such as wave pools and/or water slides, for the enjoyment of participants.

However, there is always a demand for more exciting and entertaining water play attractions and games that increase the learning and entertainment opportunities for children and that stimulate creativity and imagination.

SUMMARY

Embodiments of the invention provide unique water play attractions, game systems and methods of game play wherein gaming is carried out within a themed water play attraction comprising an existing or specially configured entertainment water play facility and/or water play structure. Certain games utilize electronically identifiable objects, such as colored balls, shaped objects, cards, bands, radio frequency identification (RFID) tagged objects and/or the like, to provide an interactive game play experience generally simulative of a computer adventure game experience. Play participants are challenged to work and cooperate with other play participants to find identified objects, clues and/or other information and to use the objects, clues and/or information to solve various puzzles or problems that present encumbrances inhibiting a player's advancement in the game.

In certain embodiments, each play participant preferably possesses a band, card or the like, that electronically identifies the play participant and that enables the play system to award and/or track points or other rewards to successful play participants individually or working with other play participants as a team. Thus, play participants participate in a computer-orchestrated adventure game, while using a physical play space and physical objects to overcome both physical and mental challenges presented by the game.

In accordance with one embodiment the present invention provides a method and system of interactive game play carried out within a water park. The game includes a plurality of electronically distinguishable play objects and one or more consoles or stations adapted to distinguish the play objects electronically. The game challenges play participants to find and use identified objects in identified consoles.

In accordance with another embodiment the present invention provides a method game play wherein play participants participate in a computer driven adventure game as they float or swim around a lazy river or other swimming channel, and using physical and/or electronic objects capable of interacting electronically with the computer driven gaming system.

In accordance with another embodiment the present invention provides a modified computer game carried out by one or more play participants within a themed water-play structure using a computer interface comprising wireless identification tags worn by play participants and electronically identifiable play objects. Optional redemption coupons, tickets, prize and/or the like may be awarded to play participants as they successfully complete each task.

In certain embodiments, an interactive water attraction is disclosed. The interactive water attraction includes a plurality of electronically identifiable objects, each comprising identification information associated with one of a plurality of play participants. The interactive water attraction also includes a plurality of consoles distributed in or near a body of water sized to accommodate at least one of the plurality of play participants. Each of the plurality of consoles may be configured to receive the identification information from at least one of the plurality of electronically identifiable objects, wherein the plurality of consoles may be further configured to play one or more games with the at least one play participant such that the at least one play participant is able to progress in the one or more games by completing at least one challenge. Furthermore, the plurality of consoles may optionally be configured for wireless communication (for example, RF communication) with the plurality of electronically identifiable objects. In addition, at least one of the plurality of electronically identifiable objects may optionally comprise a toy wand, such as for example, a water resistant toy wand or a toy wand having an RFID tag for storing the identification information.

In certain embodiments, an interactive water play attraction is disclosed for entertaining one or more play participants. The interactive water play attraction comprises a plurality of water resistant, electronically identifiable objects. The interactive water play attraction also comprises one or more game consoles configured to wirelessly communicate with at least one of the electronically identifiable objects during one or more interactive games, wherein the one or more game consoles are located in or around a body of water, and whereby a plurality of play participants use the plurality of electronically identifiable objects to play the one or more interactive games. In certain embodiments, the body of water may optionally comprise a pool, a water slide, a lazy river water ride, combinations of the same or the like. In certain embodiments, the at least one electronically identifiable object may comprise a toy wand, wherein the one or more game consoles are configured to produce one or more play effects based on information received from the toy wand.

In certain embodiments, a water attraction is disclosed for interactive game play. The water attraction includes means for electronically identifying play participants in an interactive water game environment, wherein the means for electronically identifying is water resistant. The water attraction also includes means for wirelessly communicating with the means for electronically identifying, the means for wirelessly communicating being disposed in or around multiple locations of a body of water. The means for wirelessly communicating may be further configured to play an interactive game with at least one play participant in possession of at least one of said means for electronically identifying such that the at least one play participant completes various challenges to progress in the interactive game.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF PREFERRED EMBODIMENTS

Basic System and Framework

Figure 1:
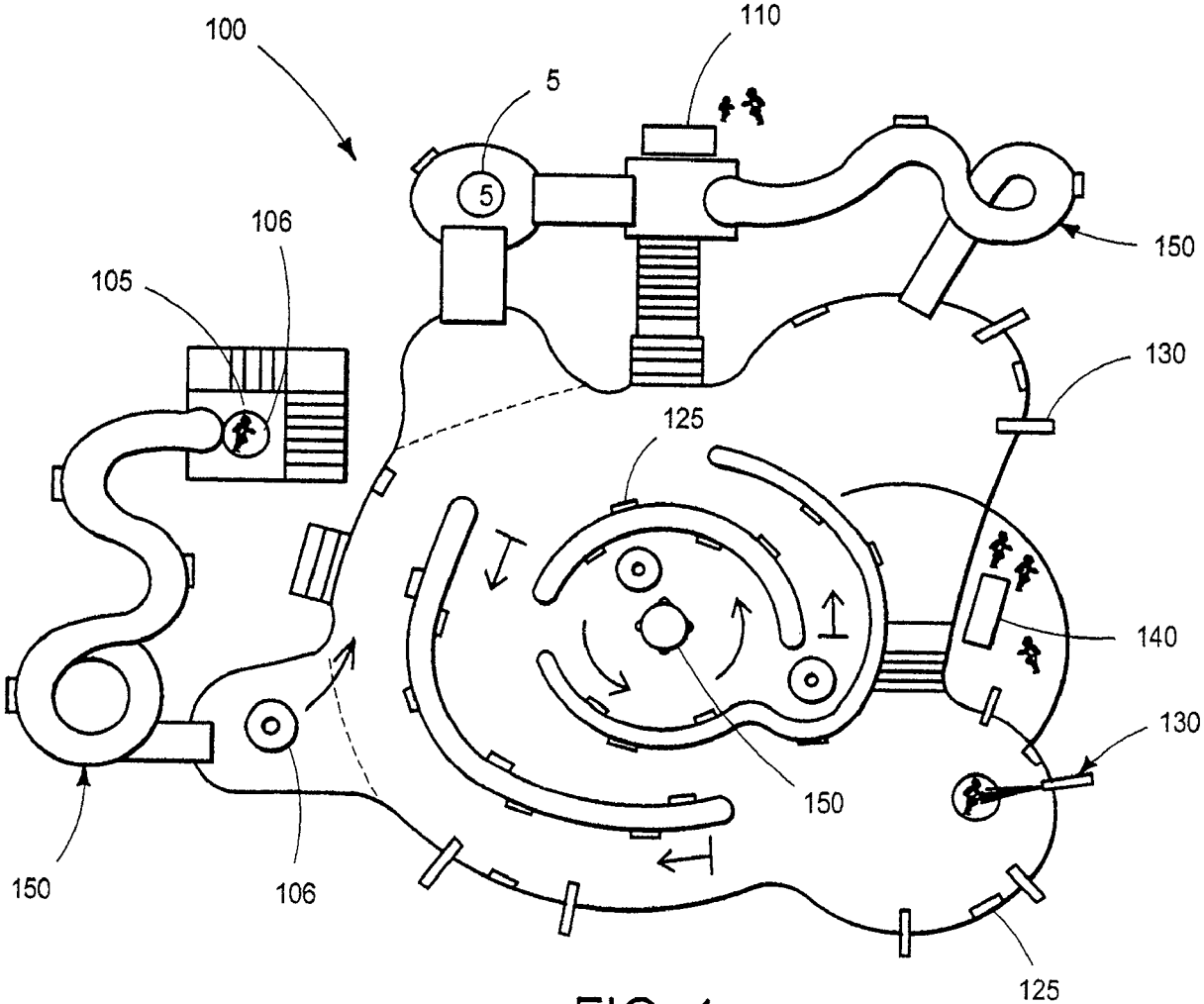
FIG. 1 is a schematic plan view of one embodiment of an RFID interactive water play attraction incorporating features and advantage in accordance with embodiments of the invention.

FIG. 1 illustrates one preferred embodiment of an interactive water play attraction 100 configured and adapted to facilitate an interactive game having features and advantages in accordance with the present invention. In certain embodiments, the interactive water play attraction includes and/or is associated with a body of water, such as, for example, one or more pools, waterslides, lazy river attractions, combinations of the same or the like.

For ease of description and understanding, the particular water attraction 100 illustrated is laid out in one level. However, those skilled in the art will readily appreciate that such an attraction may also be constructed and laid out in multiple levels, as desired, including multiple play levels, rooms, and various themed slides, chutes, climbing nets, and/or other play devices or props to be enjoyed by multiple play participants. Within the water play attraction 100, play participants 105 may ride on inner tubes 106 and/or other float vehicles as they embark on a quest to find and use various electronically-identifiable objects to solve problems, find lost treasure and/or the like.

Furthermore, certain water slides may include a number of sensors (for example, photo sensors) that are actuated by play participants sliding down the water slide to activate one or more associated play effects. Other water play systems may also be included that provide an exciting water effect that includes a giant bucket or container for collecting water discharged from a water forming device. The container is balanced and conditionally stable so that it periodically spills over when the water level in the container reaches a predetermined level. This system creates dramatic visual and sound effects for surprising, entertaining and amusing play participants.

Preferably, each play participant 105 and/or group of participants is uniquely identified via an RFID tag, card, bracelet combinations of the same or the like (described in more detail below). Identification information, such as play participant's name, age, group affiliation, or the like, may be entered using a registration station 110 located adjacent the water play attraction 100. A plurality of interactive consoles 125 are distributed throughout the structure of the water play attraction 100. Each console 125 is preferably equipped with an RFID reader adapted to electronically identify play participants via one or more wireless RFID tags or bands worn or possessed by play participants.

Optional points, redemption coupons, tickets, prize and/or the like may be awarded to play participants as they successfully complete each task. These may be printed using a dispenser or the like and/or may be recorded electronically via the RFID tag. Thus, as each play participant moves throughout the water attraction and interacts with various interactive devices comprising the game and distributed throughout the water play attraction 100, the play system is able to track and identify relevant attributes of play each participant, such as points accumulated, levels achieved, special skills acquired, combinations of the same or the like. Play participants 105 advance in the game by successfully completing various challenges presented throughout the water play attraction 100 and/or throughout the course of game play.

In certain embodiments, points are tracked and displayed on a central score board. Scores may be reported directly to the score board by each console 125, such as via Ethernet or through wireless communication. Alternatively, an intermediate point station 140 may be used to periodically collect and report points for each play participant 105 or group of play participants. In that case, each play participant 105 may present his or her band or RFID tags to the point station 140 to determine his or her points. In certain embodiments, the point stations preferably incorporate an RFID reader, which reads the RFID tag and obtains and displays the points for each participant 105. This information is then provided to the score board for display. Optionally, point information and other information may be communicated via a network, such as the internet, to a central host and/or one or more other interactive game centers.

Earned points may be used to receive redemption tickets, prizes and/or other incentives. For example, the point station 140 may be configured to issue redemption tickets according to total points accumulated by each play participant 105. Play participants 105 can then redeem the tickets for prizes, freebies, discounts or the like. Alternatively, the points stored on each RFID tag may be used to access and play associated games, such as video games and the like.

The water play attraction 100 preferably comprises multiple chutes and/or slides 150 feeding riders into a meandering lazy river constructed using any one of a number of materials and construction techniques well known to those skilled in the art. The water play attraction 100 may be suitable for either outdoor or indoor use, as desired.

Optionally, a suitable play media, such as foam, rubber, plastic or similar objects, may be provided for use throughout the water play attraction 100 to provide a tactile interactive play experience. For example, the play media may be in the shape of balls, animals (for example, ducks, fish, or the like), combinations of the same or the like. Optionally, a number of water conduits or other transport means may be provided throughout the framework of the water play attraction 100 for collecting and/or transporting play media to and from the various play areas in the water play attraction 100. The conduits may be formed from plastic pipes, such as channels joined together using commercially available fittings. Conduits may also be formed from a wide variety of other suitable materials such as steel pipe, ceramic or clay pipe, or they may be formed as open channels and/or runners, as desired. Various participant-operated or "magically" actuated conveyors may also be employed to circulate various play media from one area of the water play attraction 100 to another, as desired.

Optionally, the water play attraction 100 also preferably incorporates a number of conventional play elements, such as climbing nets, air bounce structures, trampolines, water cannons 130, balance beams, hanging bumper-bags, log crawl, tunnels, moon jumps, trolley slides, block walks, swinging or web bridges, slides and/or the like. Such play elements provide entertaining physical challenges and allow play participants to safely negotiate their way through the various areas of the water play attraction 100.

Slides 150 also may be provided at the various locations in and around the water attraction 100 and may be straight, curved, or spiral-shaped, as desired. The slides 150 may also be enclosed and tube-like or open and exposed to floating or flying play media, as desired. Alternatively, those skilled in the art will readily appreciate that the size, shape, number, and location of the various slides 150 can be varied, as desired, while still enjoying the benefits and advantages of embodiments of the present invention. Those skilled in the art will readily appreciate that a wide variety of other play elements, such as funny mirrors, rotating tunnels, trampolines, climbing bars, swings, combinations of the same, or the like may be used to create a desired play environment.

While a particular preferred play environment and water play attraction 100 has been described, it will be readily apparent to those skilled in the art that a wide variety of other possible water play environments, play structures, entertainment centers and the like may be used to create an interactive environment within which the invention may be carried out. For instance, details other interactive play structures usable with embodiments of the invention are disclosed and described in U.S. Pat. No. 6,375,578, entitled "TWO-WAY INTERACTIVE WATER SLIDE" and U.S. Pat. No. 5,820,471, entitled "PARTICIPATORY WATER PLAY SYSTEM," each of which is hereby incorporated herein by reference in its entirety to be considered a part of this specification. In certain embodiments, a suitable water play attraction may be constructed substantially entirely of molded or contoured concrete, fiberglass or plastic, as desired. In other embodiments, a suitable water play attraction may be provided by retrofitting an existing water park attraction, pool or lazy river attraction.

Game Play

In certain embodiments, game play begins at the introductory registration station 110, whereat the play participants 105 may register to play the game and/or input relevant information about themselves, such as name, age, group affiliation. Play participants 105 then proceed into the water play attraction 100 and to the various game consoles 125. The game consoles 125 preferably challenge play participants to complete a specified task (for example, find a hidden object (either floating or underwater) or clue, answer a multiple-choice question, push a button(s), jump over light beam sensor, combinations of the same or the like).

In certain embodiments, before play participants 105 begin the game, an RF Tag Reader/Writer reads the play participant's unique person identifier number (UPIN) and/or unique group identification number (UGIN) and confirms the participant's status. One or more of the consoles 125 then prompt the play participant 105 to complete a specified task. Once the interface senses that the requested task has been completed, the RF Tag Reader/Writer writes updated information to the play participant's RFID tag. This information may include, for example, the station number visited, updated number of points accumulated, error check bits/flags and/or various other information.

During game play, the play participant 105 may visit one or more optional point stations 140 to determine his or her status in the game, such as the participant's total points accumulated. The point station 140 may comprise a simple RF Tag Reader and associated display and/or may include a guest interface or other input device for more sophisticated functionality. Preferably, at least one point station 140 is disposed near the exit of the water play attraction 100. In certain embodiments, at the point station 140, participants 105 can verify and/or log their final point tally. The final point station preferably includes a RF Tag Reader/Writer. Various software in the final point station may be used to log and verify the final recorded score and communicate such information to the main score board. Optionally, once the score has been logged and verified, the final point station may "reset" the play participant's RFID tag so that the play participant 105 may turn in the RFID tag at the exit gate to be used by another play participant 105.

In certain embodiments, the RFID tag or like device of the play participant 105 may track and/or store information regarding the progress of the play participant 105 in the interactive water game. In yet other embodiments, one or more of the point stations 140 may be linked together, such as through a wired or wireless network, and/or the point stations 140 may communicate with a central computer that tracks the progress of each of the participants 105.

Game Consoles

In certain embodiments illustrated and described above, multiple interactive quest consoles 125 are preferably arranged throughout the water play attraction 100. For instance, one or more of the consoles 125 may be positioned or distributed on or near a body of water, such as a pool, a water slide, a lazy river attraction, combinations of the same or the like. Game consoles 125 may be out in the open or hidden, as desired.

Figure 2:
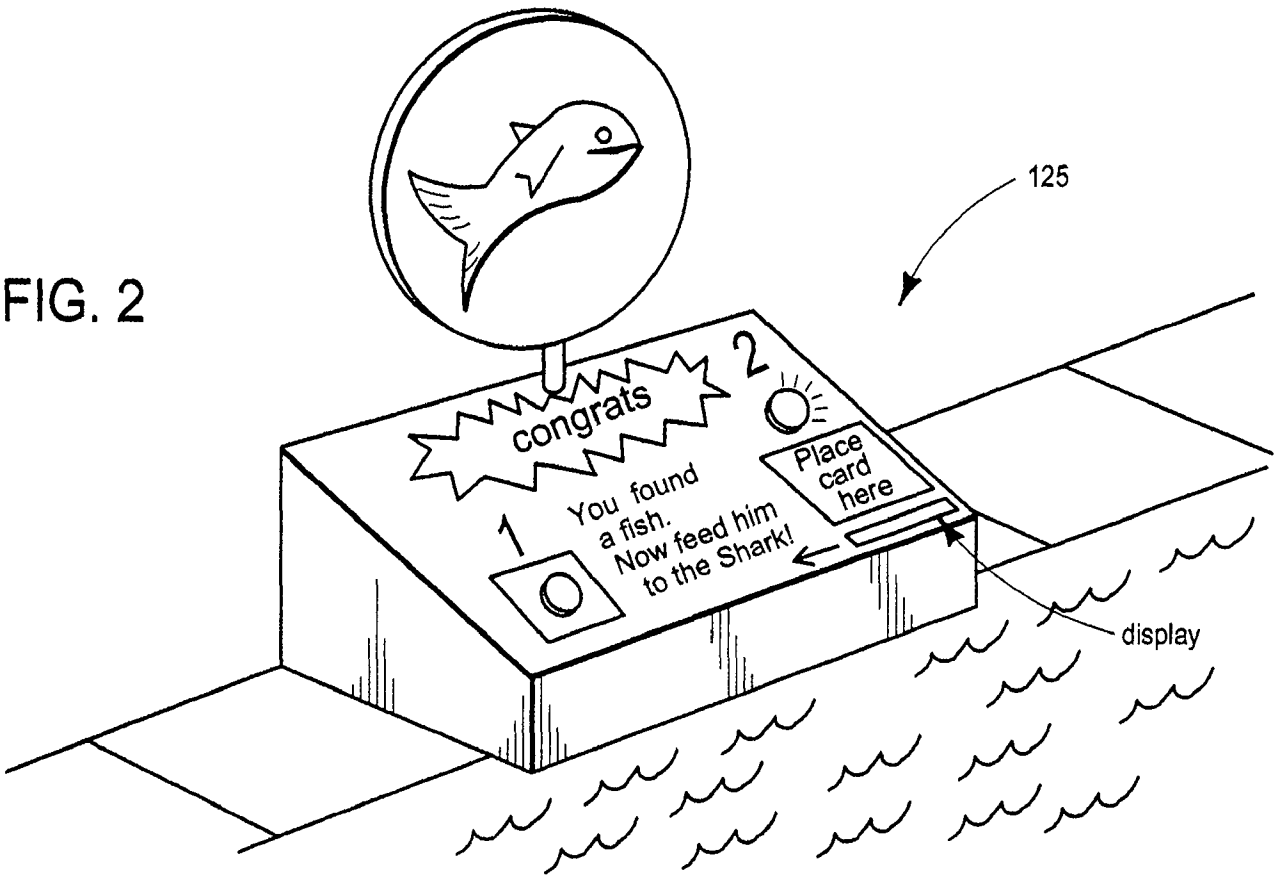
FIG. 2 is a perspective view of one embodiment of an interactive game console having features and advantages in accordance with embodiments of the invention.

One preferred embodiment of a game console 125 is illustrated in FIG. 2. In such an embodiment, the game console 125 preferably includes an RFID reader/writer adapted to read and/or write to the RFID tags or bracelets worn by play participants 105. Play participants 105 find each console 125 and use the RFID tags/bands to receive points and/or complete a game. Preferably, game play follows a story line that play participants 105 learn as they play. Play participants 105 may learn clues and/or gather objects or tools that enable them to progress through the game, solve a mystery, or complete a quest or treasure hunt. Such objects and/or tools may comprise physical and/or electronic (virtual) items.

In certain embodiments, the various consoles 125 are arranged and programmed such that they may be visited and operated in a particular order by the play participant(s) 105 to complete the game and earn a particular number of points. For example, certain consoles 125 may only be activated if the play participant 105 has already visited and received points or information from other consoles 125 within (or outside) the water play attraction 100. The game play may be similar to a typical interactive computer adventure game.

Figure 3:
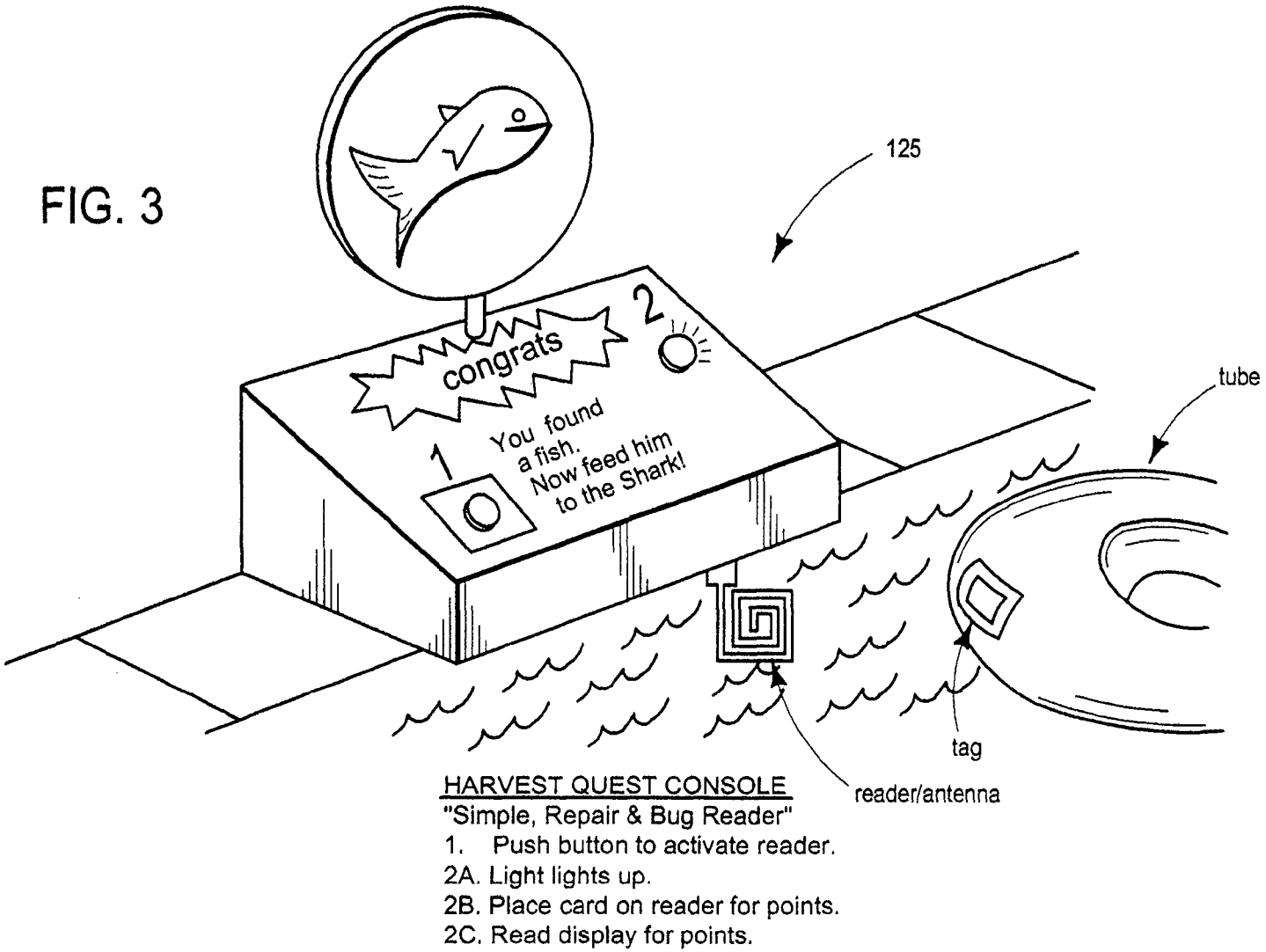
FIG. 3 is a perspective view of an alternative embodiment of an interactive game console having features and advantages in accordance with embodiments of the invention.

FIG. 3 illustrates another preferred embodiment of a game console 125. In this embodiment, the antenna or "pick up" portion of the RFID readers/writer is disposed outside the console 125 so as to more-easily communicate with one or more RFID tags, such as those affixed directly to the inner tube 106.

In certain embodiments, the consoles 125 may also be use to track the location of the play participants. For instance, one or more of the consoles 125 may provide information to central processor and/or other electronic devices regarding the current location of a play participant, a history of locations visited, or the like. Such information may be advantageously used, for example, by parents to remotely monitor the location of children throughout the game play and/or to find a lost child.

RFID Tags and Readers

As indicated above, each play participant 105 within the water play attraction 100 preferably receives an electronic identification device, such as, for example, an RFID tag or transponder ("tag"). The tag allows play participants 105 to electronically interact with the various quest consoles 125 to achieve desired goals or produce desired effects within the play environment. Play participants 105 preferably collect points and/or earn additional levels or ranks for each interactive console 125 they successfully complete. In this manner, play participants 105 may compete with one another to see who can score more points and/or achieve the highest levels in the quest game.

RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 4A:
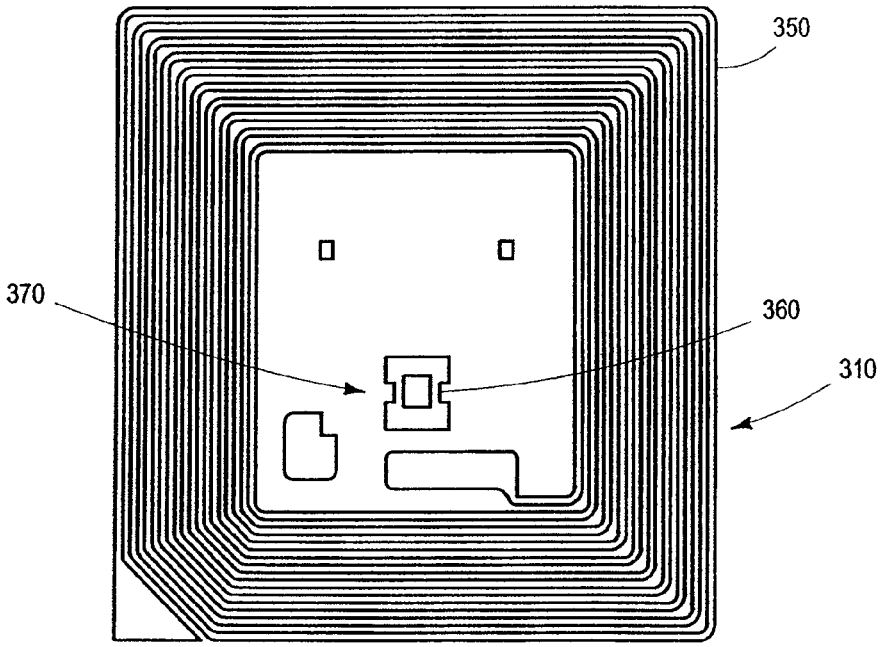
FIG. 4A is a detail plan view of one embodiment of an RFID tag device for use in accordance with one preferred embodiment of an interactive water play structure and game having features and advantages in accordance with embodiments of the invention.

FIG. 4A is a detailed schematic view of one embodiment of an RFID tag device 310 for use with certain embodiments of a water quest game. The illustrated tag 310 preferably comprises an RF tag pre-programmed with a UPIN or a quest object identification number (UOIN). Other stored information (either pre-programmed or programmed later) may include, for example, the play participant's name, age, rank or level achieved, total points accumulated, tasks completed, facilities visited, combinations of the same or the like. As shown, the tag 310 generally comprises a spiral wound antenna 350, a RF transmitter chip 360 and various electrical leads and terminals 370 connecting the chip 360 to the antenna 350.

The tag 310 may be a passive tag or battery-powered, as expedience and costs dictate. Preferably, the tag 310 is passive (requires no batteries) so that it is inexpensive to purchase and maintain. Such tags and various associated readers and other accessories are commercially available in a wide variety of configurations, sizes and read ranges. RFID tags having a read range of between about 10 centimeters to about 100 centimeters are particularly preferred, although shorter or longer read ranges may also be acceptable. The particular tag 310 illustrated is the 13.56 megahertz tag sold under the brand name TAGGIT™ available from Texas Instruments, Inc. (http://www.tiris.com, Product No. RI-103-110A).

In certain embodiments, the tag 310 has a useful read/write range of about 25 centimeters and contains 256-bits of on-board memory arranged in 8×32-bit blocks which may be programmed (written) and read by a suitably configured read/write device. If a longer read/write range (for example, 1 to 100 meters) and/or more memory (for example, 1 to 100 megabytes) is desired, optional battery-powered tags may be used instead, such as the AXCESS active RFID network system available from AXCESS, Inc. and/or various other RF-based asset and people tracking applications known to those skilled in the art.

Figure 4B:
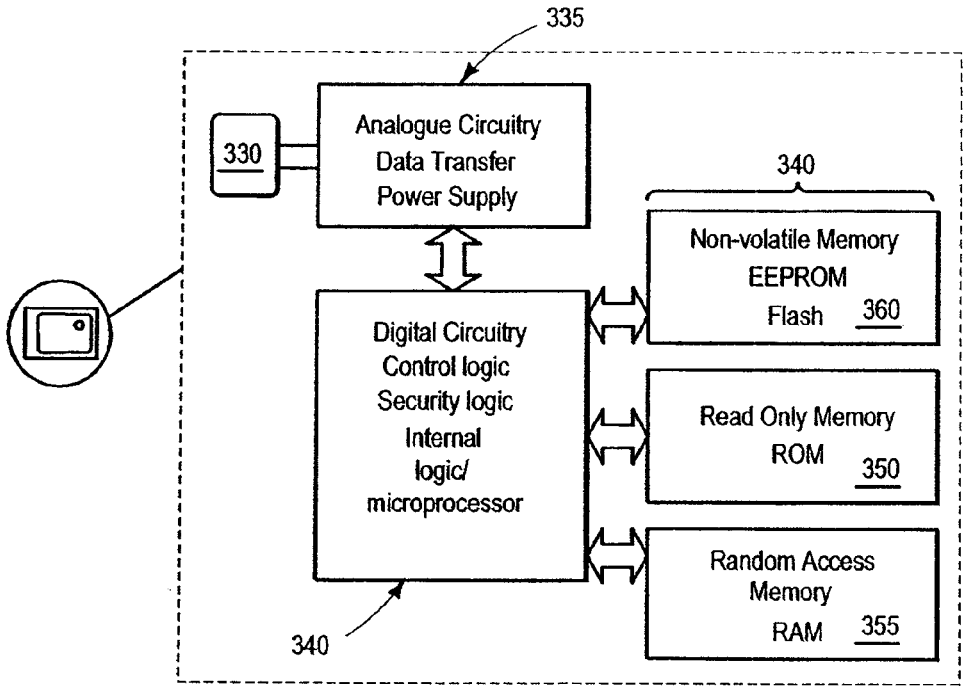
FIG. 4B is a schematic circuit diagram of one embodiment of an RFID tag device, illustrating the basic organization and function of the electronic circuitry comprising the RFID tag device of FIG. 4A for use in accordance with embodiments of the invention.

FIG. 4B is a simplified block diagram illustrating the organization and function of the electronic circuitry comprising the RF transmitter chip 360 of the RFID tag device 310 of FIG. 4A. The illustrated chip 360 comprises a processor 430, analogue circuitry 435, digital circuitry 440 and on-board memory 445. On-board memory 445 is divided into read-only memory (ROM) 450, random access memory (RAM) 455 and non-volatile programmable memory 460, which is available for data storage. The ROM-based memory 450 is used to accommodate security data and the tag operating system instructions which, in conjunction with the processor 430 and processing logic deals with the internal "house-keeping" functions such as response delay timing, data flow control and power supply switching.

The RAM-based memory 455 facilitates temporary data storage during transponder interrogation and response. The non-volatile programmable memory 460 may take various forms, such as for example electrically erasable programmable read only memory (EEPROM). In certain embodiments, the RAM-based memory 455 is used to store the transponder data and is preferably non-volatile to ensure that the data is retained when the device is in its quiescent or power-saving "sleep" state. Various data buffers or further memory components (not shown), may also be provided to temporarily hold incoming data following demodulation and outgoing data for modulation and interface with the transponder antenna 350.

Analog circuitry 335 provides the facility to direct and accommodate the interrogation field energy for powering purposes in passive transponders and triggering of the transponder response. Analog circuitry 335 also provides the facility to accept the programming or "write" data modulated signal and to perform the necessary demodulation and data transfer processes. Digital circuitry 440 provides certain control logic, security logic and internal microprocessor logic required to operate the processor 430.

Advantageously, the UPIN stored on each tag 310 may be used to wirelessly identify and track individual play participants 105 within the water play attraction 100. Optionally, each tag 310 may also include a UGIN that may be used to match one or more play participants 105 to a particular group or team. If desired, the tag 310 may be covered with an adhesive paper label (not shown) for surface adhesion to a quest object, clothes, or any other tag bearing surface. More preferably, the tag 310 may be molded and/or embedded into a relatively stiff plastic sheet substrate and/or transponder cylinder which holds and supports the tag 310. Optionally, the sheet substrate, transponder or other support structure may take on any other fanciful shape, as desired. The resulting structures may be inserted into and/or affixed to the various quest objects, and/or they may be worn externally by play participants (for example, as a bracelet, necklace, key chain trinket, sticker, name badge, or the like).

In certain embodiments, the electronically identifiable objects used by the play participants 105 in the water play attraction 100 may include one or more devices that are carried by a play participant. For example, in certain embodiments, an electronically identifiable object may comprise a toy wand that the participant 105 uses to communicate with one or more game consoles 125. The toy wand may be configured to store, such as in a memory or an RFID tag, identification information associated with the respective play participant 105. Such information may be used by one or more processors and/or by one or more game consoles 105 to track the progress of the play participant 105 in a particular interactive water game.

In certain embodiments, the toy wand may wirelessly communicate with one or more game consoles 125 through RF, infrared, or like communications. For instance, the toy wand may include an RFID tag (for example, passive RFID tag), such as is described in more detail above, that stores identification information and that communicates with an RFID reader of one or more game consoles 125.

In certain embodiments, the toy wand further comprises activation circuitry capable of wirelessly communicating one or more command signals to one or more game consoles 125 during the course of an interactive game. For instance, the activation circuitry may be responsive to one or more particular directions of the toy wand to communicate with the game console 125 and/or to cause one or more play effects, to solve a puzzle or challenge, to answer a question, combinations of the same or the like.

Examples of designs and/or circuitry of toy wands usable with embodiments of the invention are described in more detail in U.S. Patent Publication No. 2005-0143173, published Jun. 30, 2005, and entitled "MAGICAL WAND AND INTERACTIVE PLAY EXPERIENCE," which is incorporated herein by reference in its entirety.

In certain embodiments, the electronically identifiable objects, such as the toy wand, are preferably waterproof and/or water resistant. Such a design advantageously prevents internal circuitry associated with the electronically identifiable object from being adversely affected by water from the surrounding water play attraction 100. For instance, the toy wand may be constructed of a plastic, rubber or like material. In other embodiments, the toy wand may be substantially surrounded by a waterproof or water resistant covering or skin.

In operation, various RFID reader (and/or reader/writer) devices are provided and may be distributed throughout the water play attraction 100. In certain embodiments, the readers are able to read the information stored on each tag 310 when the associated participant 105 or object is brought into suitable proximity of the reader (for example, 1 to 100 centimeters). Advantageously, because radio waves can easily penetrate solid objects, such as plastic and the like, the tag 310 may be mounted internally within a cavity of the quest object, thereby providing an internal communication and information storage means for each quest object.

Tags may also be worn close to the body, such as around a participant's wrist or on/in a participant's clothing. Thus, the UPIN, UOIN and/or UGIN information may be conveniently read and easily communicated to a quest console 125, computer monitor, interactive game control system, display system or other tracking, recording or displaying device for purposes of identifying, logging and/or creating a record of each play participant's experience. Additional information (for example, unique personality traits, special powers, skill levels, or the like) may also be easily stored on each tag, thus providing further character development and interactive gaming possibilities.

Figure 5A:
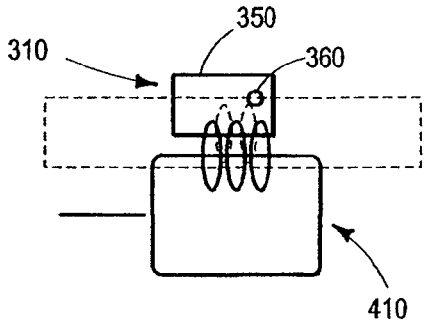
FIGS. 5A and 5B are schematic diagrams illustrating typical operation of the RFID tag device of FIG. 4.
Figure 5B:
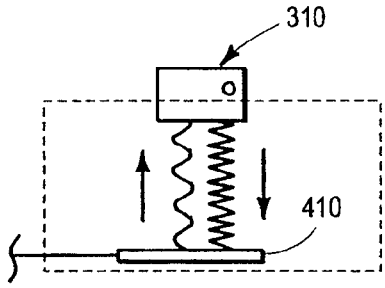
Figure 6A:
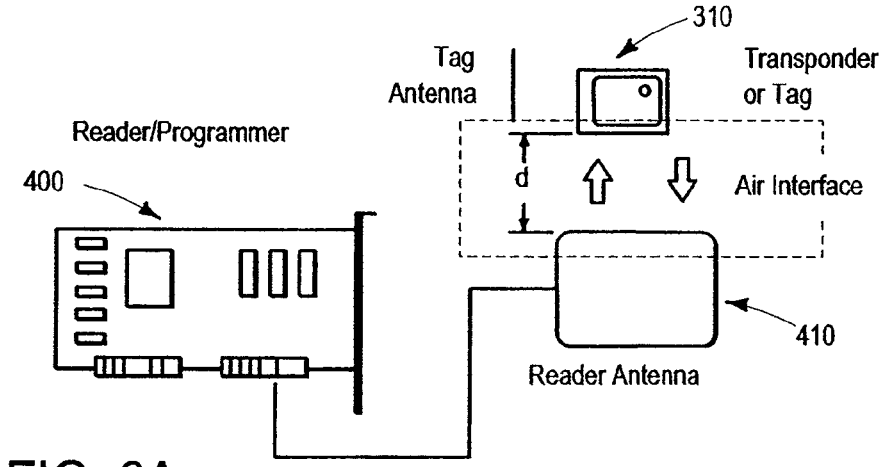
FIGS. 6A and 6B are simplified schematic diagrams of one embodiment of an RFID read/write system for use with the RFID tag device of FIG. 4 and having features and advantages in accordance with embodiments of the invention.
Figure 6B:
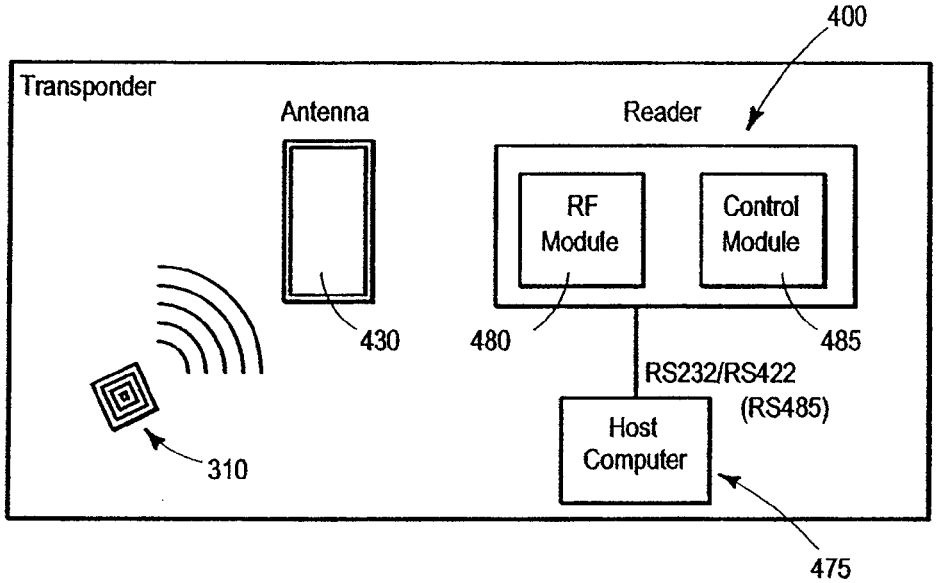
Figure 7:
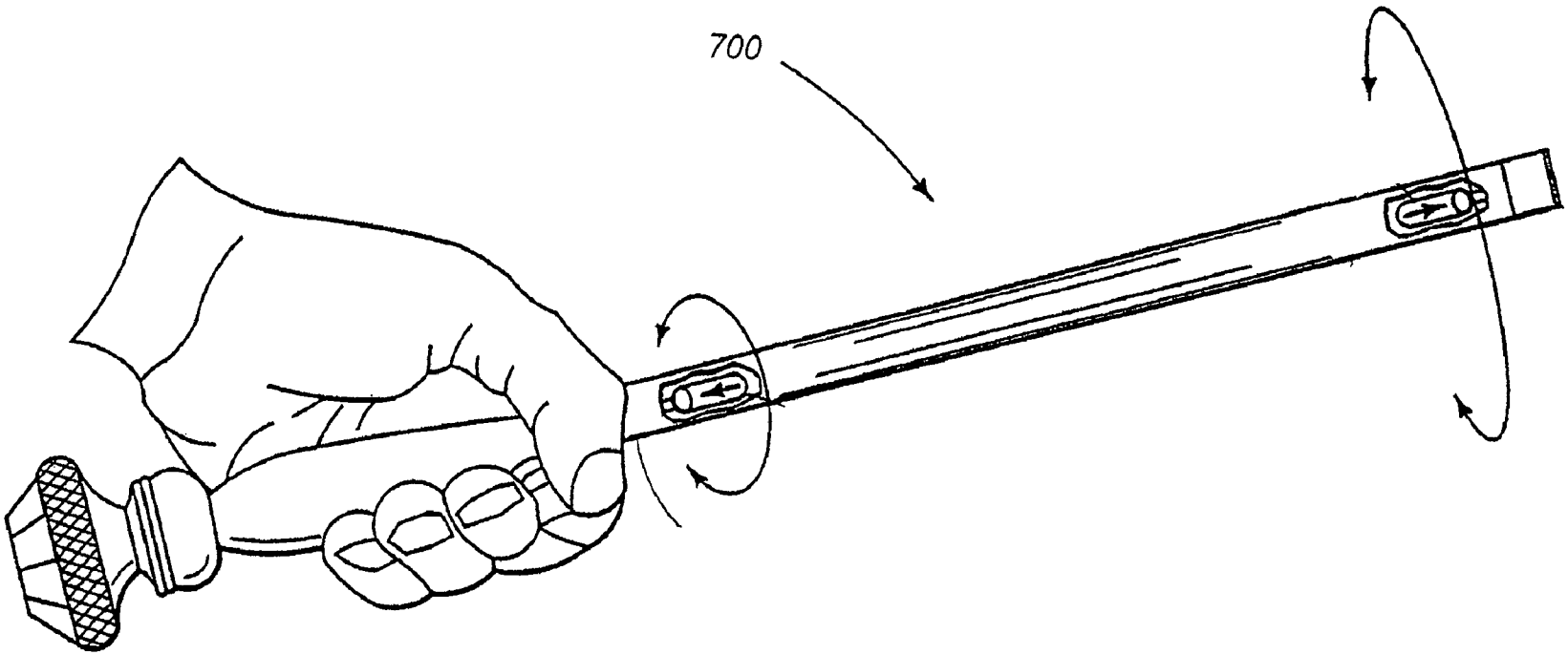
FIG. 7 illustrates one embodiment of a waterproof wand.

FIGS. 5 and 6 are simplified schematic illustrations of embodiments of a tag and reader operation. In certain embodiments, the tag 310 is initially activated by an RF signal broadcast by an antenna 410 of an adjacent reader or activation device 400. The signal impresses a voltage upon the antenna 350 by inductive coupling, which voltage is then used to power the chip 360 (see, for example, FIG. 4A). When activated, the chip 360 transmits via RF a unique identification number preferably corresponding to the UPIN, UOIN and/or UGIN described above (see, for example, FIG. 4A and associated discussion). In certain embodiments, the signal may be transmitted either by inductive coupling or, more preferably, by propagation coupling over a distance "d" determined by the range of the tag/reader combination. This signal is then received and processed by the associated reader 400, as described above, and communicated to a host computer 475. If desired, the RFID tag or transponder 310 may also be configured for read/write communications with an associated reader/writer. Thus, the unique tag identifier number (UPIN, UGIN or UO1N) and any other stored information may be read or changed, or other information may be added. FIG. 7 illustrates one embodiment of a waterproof wand device 700 that includes a tag 310.

As indicated above, in certain embodiments, communication of data between a tag and a reader is advantageously by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 400 so as to reduce the probability of such data transmission errors. In certain embodiments, the readers are preferably placed at least 30 to 60 centimeters away from metal objects, power lines or other potential interference sources. Those skilled in the art will also recognize that the write range of the tag/reader combination is typically somewhat less, such as, for example, approximately 10 to approximately 15 percent less, than the read range "d" and, thus, this should also be taken into account in determining the placement and positioning of each reader device 400.

Typical RFID data communication is asynchronous or unsynchronized in nature and, thus, particular attention should be given in considering the form in which the data is to be communicated. In certain embodiments, structuring the bit stream of the wireless communications, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are also well known to those skilled in the art and will not be further discussed herein.

The choice of carrier wave frequency is also important in determining data transfer rates. Generally speaking, the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

The water-based quest game in accordance with the above-described example provides a challenging, computer-orchestrated interactive gaming experience within a physical play space using electronically-identifiable physical objects as an interactive play medium. In yet other embodiments, wireless communications other than, or in addition to, RF communications may be used in the water-based quest game. The game provides participants with the intellectual challenge and excitement of a computer adventure game, but with tangible interactives, physical challenges, and social interaction.

Additionally, certain embodiments of the water-based games described herein may further comprise a retail phase in which a play participant may purchase, rent, or acquire one or more objects for use in the water-based quest game. For instance, a play participant may purchase one of the electronically identifiable objects (for example, a toy wand) before, during or after participating in the water-based game. Such a retail phase advantageously allows a user to retain a record of his or her progress through his or her purchased object, which may be repeatedly used in multiple games, such as games played on different days, or in other interactive games or environments, including water-based and/or non-water-based games. Further details of systems and methods for integrating interactive game play with a retail environment are disclosed in U.S. patent application Ser. No. 11/274,760, filed Nov. 15, 2005, and entitled "MULTI-LAYERED INTERACTIVE PLAY EXPERIENCE," which is hereby incorporated herein by reference in its entirety to be considered a part of this specification.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive play device for a water play attraction for entertaining one or more play participants, the interactive play device comprising:

a memory configured to store unique identification information associated with one of a plurality of play participants in an interactive water game;

a transceiver in communication with the memory, wherein the transceiver is configured to wirelessly communicate with a plurality of game consoles distributed throughout an interactive water play environment, wherein said wireless communication comprises at least transmitting (i) the unique identification information to the plurality of game consoles, and (ii) game data configured to activate one or more play effects controlled by the plurality of game consoles; and a waterproof covering substantially enclosing at least the memory and the transceiver and configured to be worn on a hand of the one of the plurality of play participants.

2. The interactive play device of claim 1, wherein the memory comprises a radio frequency identification (RFID) tag.

3. The interactive play device of claim 2, wherein the RFID tag is a passive RFID tag.

4. The interactive play device of claim 1, further comprising activation circuitry configured to generate the game data in response to at least one of a plurality of particular motions of the interactive play device.

5. The interactive play device of claim 1, wherein said wireless communication comprises at least one of radio frequency (RF) communication and infrared communication.

6. The interactive play device of claim 1, wherein the memory is further configured to store at least one of a group affiliation of the one of the plurality of play participants, a progress of the one of the plurality of play participants in the interactive water game, and a number of tasks completed by the one of the plurality of play participants in the interactive water game.

7. The interactive play device of claim 6, wherein the transceiver is further configured to receive from the plurality of game consoles information indicative of the progress or the number of tasks completed.

8. The interactive play device of claim 1, wherein the waterproof covering is in the form of a bracelet.

9. The interactive play device of claim 1, wherein the interactive water game comprises a plurality of interactive water challenges to be completed by the one of the plurality of play participants.

10. The interactive play device of claim 1, wherein the waterproof covering comprises a plastic substrate.

11. The interactive play device of claim 1, wherein at least the memory and the transceiver are embedded in the waterproof covering.

12. The interactive play device of claim 1, wherein the covering is configured to adhere to the one of the plurality of play participants.

13. An interactive play device for a water play attraction for entertaining one or more play participants, the interactive play device comprising:

a memory configured to store, player identification information associated with a play participant in an interactive water game, and progress information indicative of a progress of the play participant in the interactive water game;

a transceiver coupled to the memory, wherein the transceiver is configured to wirelessly communicate with a plurality of game consoles distributed throughout an interactive water play environment during the interactive water game, wherein said wireless communication comprises at least transmitting (i) the player identification information to the plurality of game consoles, and (ii) the progress information to activate one or more play effects by the plurality of game consoles; and a water resistant substrate substantially enclosing at least the memory and the transceiver and configured to be worn on a hand of the play participant.

14. The interactive play device of claim 13, further comprising activation circuitry configured to trigger the transceiver to transmit the player identification data and the progress data.

15. The interactive play device of claim 14, wherein said triggering is in response to a particular movement of the interactive play device with respect to at least one of the plurality of game consoles.

16. The interactive play device of claim 14, wherein said triggering is in response to a request from at least one of the plurality of game consoles.

17. The interactive play device of claim 13, wherein the progress information is indicative of a number of challenges completed by the play participant in the interactive water game.

18. The interactive play device of claim 13, wherein the progress information is indicative of a gaming level of the play participant.

19. An interactive play device for a water play attraction for entertaining one or more play participants, the interactive play device comprising:

means for storing unique identification information associated with one of a plurality of play participants in an interactive water game;

means for wirelessly communicating with a plurality of game consoles distributed throughout an interactive water play environment, wherein said wireless communication comprises at least transmitting (i) the unique identification information to the plurality of game consoles, and (ii) game data configured to activate one or more play effects controlled by the plurality of game consoles; and waterproof means for substantially enclosing at least said storing means and said communicating means and formed to be worn on a hand of the one of the plurality of play participants.

20. The interactive play device of claim 19, wherein said waterproof means is configured to be inserted over the hand of the one of the plurality of play participants.

* * * * *